US012611607B2

(12) United States Patent
LaPointe et al.

(10) Patent No.: US 12,611,607 B2
(45) Date of Patent: Apr. 28, 2026

(54) ARTICULATING APPARATUS

(71) Applicants: Michael LaPointe, Anchorage, AK (US); Dan Dyble, Powell River (CA)

(72) Inventors: Michael LaPointe, Anchorage, AK (US); Dan Dyble, Powell River (CA)

( * ) Notice: Subject to any disclaimer, the term of this patent is extended or adjusted under 35 U.S.C. 154(b) by 17 days.

(21) Appl. No.: 18/854,573

(22) PCT Filed: Apr. 7, 2023

(86) PCT No.: PCT/US2023/017910
§ 371 (c)(1),
(2) Date: Oct. 7, 2024

(87) PCT Pub. No.: WO2023/196611
PCT Pub. Date: Oct. 12, 2023

(65) Prior Publication Data

US 2025/0108311 A1 Apr. 3, 2025

Related U.S. Application Data

(60) Provisional application No. 63/328,913, filed on Apr. 8, 2022.

(51) Int. Cl.
*A63H 3/46* (2006.01)
*A63H 3/20* (2006.01)
*A63H 13/18* (2006.01)

(52) U.S. Cl.
CPC ..... *A63H 3/46* (2013.01); *A63H 3/20* (2013.01); *A63H 13/18* (2013.01)

(58) Field of Classification Search
CPC . A63H 3/18; A63H 3/20; A63H 13/16; A63H 13/18
See application file for complete search history.

(56) References Cited

U.S. PATENT DOCUMENTS 1,580,820 A * 4/1926 Gensicki ..... A63H 13/04 446/145
2,070,452 A * 2/1937 Pryor ..... A63H 13/04 446/357
2,760,303 A * 8/1956 Del Mas ..... A63H 3/16 40/418
3,874,112 A * 4/1975 Sapkus ..... A63H 13/12 446/268
3,906,661 A * 9/1975 Weiser ..... A63H 3/20 446/336
4,605,382 A * 8/1986 Cook ..... A63H 3/20 446/330

(Continued)

FOREIGN PATENT DOCUMENTS

CN 209714282 U 12/2019

*Primary Examiner* — Eugene L Kim
*Assistant Examiner* — Alyssa M Hylinski

(57) ABSTRACT

The present invention discloses an articulating apparatus. The apparatus comprises one or more objects. Each object comprises one or more bobbling components. Further, two or more bobbling components of one or more objects are connected together. The apparatus further comprises one or more joining modules. The joining modules are configured to movably connect each bobbling component to the respective object and enables the two or more connected bobbling components of one or more objects to bobble synergistically in unison.

4 Claims, 18 Drawing Sheets

(56) References Cited

U.S. PATENT DOCUMENTS

| | | | | |
|---|---|---|---|---|
| 5,664,983 | A * | 9/1997 | Hollis | A63H 3/20 446/199 |
| 6,142,851 | A * | 11/2000 | Lewinski | A63H 3/20 446/330 |
| 6,511,359 | B1 | 1/2003 | Lui | |
| 6,840,838 | B1 * | 1/2005 | Reid | A63H 3/18 446/365 |
| 7,934,973 | B2 * | 5/2011 | Trageser | A63H 3/46 446/180 |
| 8,043,138 | B2 * | 10/2011 | Buckley | A63H 3/50 446/280 |
| 9,827,504 | B2 | 11/2017 | Olson | |
| 10,981,075 | B2 * | 4/2021 | Bellon | A63H 3/20 |
| 2003/0166374 | A1 * | 9/2003 | Nelson | A63H 3/04 446/379 |
| 2005/0001113 | A1 | 1/2005 | Sullivan et al. | |
| 2010/0170122 | A1 | 7/2010 | Moy | |
| 2013/0045659 | A1 | 2/2013 | Tobias | |
| 2018/0021686 | A1 | 1/2018 | Vaughn | |

* cited by examiner

ARTICULATING APPARATUS

CROSS-REFERENCE TO RELATED APPLICATION

The present application claims the benefit of International Application No. PCT/US2023/017910 filed on 7 Apr. 2023, entitled "ARTICULATING APPARATUS" which further claims the benefit of U.S. provisional application U.S. 63/328,913 filed on 8 Apr. 2022 entitled "AN APPARATUS FOR FACILITATING MOVEMENT OF ONE OR MORE COMPONENTS OF TWO OR MORE PHYSICALLY CONNECTED OBJECTS", the contents of which are hereby incorporated by reference.

TECHNICAL FIELD

The present invention generally relates to an articulating apparatus. More specifically, the present invention relates to an articulating apparatus comprising one or more objects having two or more connected bobbling components.

BACKGROUND

Generally, the articulated objects have one or more parts connected together and facilitate the relative movement of the connected parts. Such articulated objects are technologically important to several industries including toy industry, residential and commercial architecture, automotive vehicles, robots, manufacturing industries, and other industries. The benefits of articulated objects are different in each industry. The benefits of the articulated objects in the toy industry includes gifting, enjoyment, entertainment, decoration, etc. In other industries including architecture and automotive vehicles, the benefits of articulated objects include various forms of aesthetic and practical benefits.

Referring to FIG. 1, a conventional bobbling apparatus 100 comprises a human figurine 102 and a head component 104. The bobbling head component 104 is attached to the human figurine 102 via a spring 106. Referring to FIG. 2, another conventional bobbling apparatus 200 comprises a human figurine 202, a first arm component 204, and a second arm component 206. The first arm component 204 is attached to the human figurine 202 via a first conical spring 208 and the second arm component 206 is attached to the human figurine 202 via a second conical spring 210. The conventional bobbling apparatuses (100, 200) enables the bobbling of one separate component. The existing apparatus (100, 200) enables the motion of each bobbling component (104, 204, 206), individually. Thus, each bobbling component (104, 204, 206) requires a separate mechanism to bobble, individually. This problem is limiting as it restricts the number or type of bobblehead dolls that could be made using the existing technology. Further, few existing patent applications attempt to address the problems cited in the background as prior art over the presently disclosed subject matter and are explained as follows.

U.S. Pat. No. 9,827,504B2 assigned to Kenneth E. Olson, entitled "vibratory device for bobble toys" discloses a vibratory device for inducing movement to a bobble toy. The device comprises a base having magnetic members, a platform for supporting the bobble toy having a bobble head, and springs to support the platform over the base. The device further comprises a control circuity to activate and deactivate the magnetic members to induce a pattern of vibration to the bobble head of the toy.

US20130045659A1 assigned to Michael US C. Tobias, entitled "bobble doll with movable lower body" discloses a bobble doll device including a base, a support stanchion, a stationary upper body portion and a movable lower body portion. The support stanchion extends outwardly from the base and supports the upper body portion to remain stationary. A spring is attached to a bottom part of the upper body portion and to a top part of the lower body portion such that the lower body portion is movable in a reciprocating motion in relation to the upper body portion. However, the existing prior arts also enables the bobbling of bobbling components, individually.

Therefore, there is a need for an improved articulated apparatus that overcomes one or more of the above-mentioned limitations of the conventional bobbling apparatus and are more appealing, having wide industrial applicability, user friendly, entertaining, and cost effective.

SUMMARY

The present invention discloses an articulating apparatus. The apparatus comprises one or more objects. Each object comprises one or more bobbling components. Further, two or more bobbling components of one or more objects are connected together. In one embodiment, two or more bobbling components are integrally connected together. The apparatus further comprises one or more joining modules. The joining module refers to the module that enables movement of the bobbling components connected to the object. In one embodiment, the joining module comprises one or more components selected from a group comprising one or more magnets, one or more electromagnets a spring, a conical spring, a leaf spring, a compression spring, a torsional spring, a garter spring, a hinge joint, a pivot joint, a prismatic joint, a ball-socket joint, an electromechanical device and a mechanism having a hook and loop component, a conical component, and a component balanced on a post. The mechanism enables a hollow interior of the bobbling component to balance on a pointed stick of the object, which enables the bobbling component to oscillate relative to the pointed stick.

The joining modules are configured to movably connect each bobbling component to the respective object and enables the two or more connected bobbling components of one or more objects to bobble synergistically in unison.

The apparatus further comprises one or more connecting modules configured to connect two or more bobbling components of one or more objects. In one embodiment, at least one connecting module is configured to detachably connect two or more bobbling components. The connecting module refers to a module that connects two or more bobbling components. Further, the connecting module, connecting two or more bobbling components, enable those components to move together in unison. In one embodiment, the connecting module comprises one or more components selected from a group comprising one or more magnets, one or more electromagnets, a Velcro® fastener, a snap fastener a glue fastener, a reusable bonding material, a reusable tape, suction cups and an electromechanical device. The electromechanical device includes, but not limited to, electric motor, solenoid and electromagnet.

In one embodiment, the connecting module comprises a first rack and pinion set connected to at least one bobbling component. The first rack and pinion set comprising a first rack, and a first pinion disposed over a first shaft. The first pinion is drivingly engaged to the first rack to cause linear translation of the first rack coincident with a rotation of the first pinion.

The connecting module further comprises a second rack and pinion set connected to at least another bobbling component. The second rack and pinion set comprising a second rack, and a second pinion disposed over a second shaft. The second pinion is drivingly engaged to the second rack to cause linear translation of the second rack coincident with a rotation of the second pinion.

The connecting module further comprises a conveyer belt configured to mechanically couple the first shaft and the second shaft and transmit rotational motion between the first pinion and the second pinion. The connecting module further comprises a spring disposed between the first rack and second rack. When the first rack moves against the second rack on application of rotational force on one of the first pinion and the second pinion, the spring is configured to retract, and when the first rack moves away from the second rack on application of rotational force on one of the first pinion and the second pinion, the spring is configured to expand, thereby the connecting modules imparts bobbling movement to at least two bobbling components.

In another embodiment, the connecting module comprises a receptacle member having a first portion and a second portion opposite to the first portion. The first portion of the receptacle member is connected to at least one bobbling component.

The connecting module further comprises a mobile member having a first portion and a second portion opposite to the first portion. The first portion of the mobile member is configured to linearly move within the second portion of the receptacle member.

The connecting module further comprises an elastic member having a first portion and a second portion opposite to the first portion. The first portion of the elastic member is connected to the second portion of the mobile member and the second portion of the elastic member is connected to the at least one other bobbling component. When the mobile member moves towards the first portion of the receptacle member, the elastic member is enabled to expand and when the mobile member moves away from the first portion of the receptacle member, the elastic member is enabled to contract, thereby the connecting module imparts movement to at least two bobbling components.

In one embodiment, the one or more objects comprises a first object. The first object comprises one or more first bobbling components. The one or more joining modules comprises one or more first joining modules. Each first bobbling component is connected to the first object via at least one first joining module. Further, at least two first bobbling components are attached to one another via at least one connecting module. The one or more first joining modules and the at least one connecting module are configured to enable the at least two first bobbling components to bobble synergistically in unison.

In another embodiment, the one or more objects comprises a second object, and the one or more joining modules comprises one or more second joining modules. Further, the second object comprises one or more second bobbling components. Each second bobbling component is movably connected to the second object via at least one second joining module. Further, at least one first bobbling component is connected to the at least one second bobbling component via at least one connecting module. The at least one second joining module and the at least one connecting module are configured to enable the first bobbling component and the second bobbling component to bobble synergistically in unison.

The above summary contains simplifications, generalizations, and omissions of detail and is not intended as a comprehensive description of the claimed subject matter but, rather, is intended to provide a brief overview of some of the functionality associated with the claimed subject matter. Other systems, methods, functionality, features, and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION OF EXAMPLE EMBODIMENTS

Figure 1:
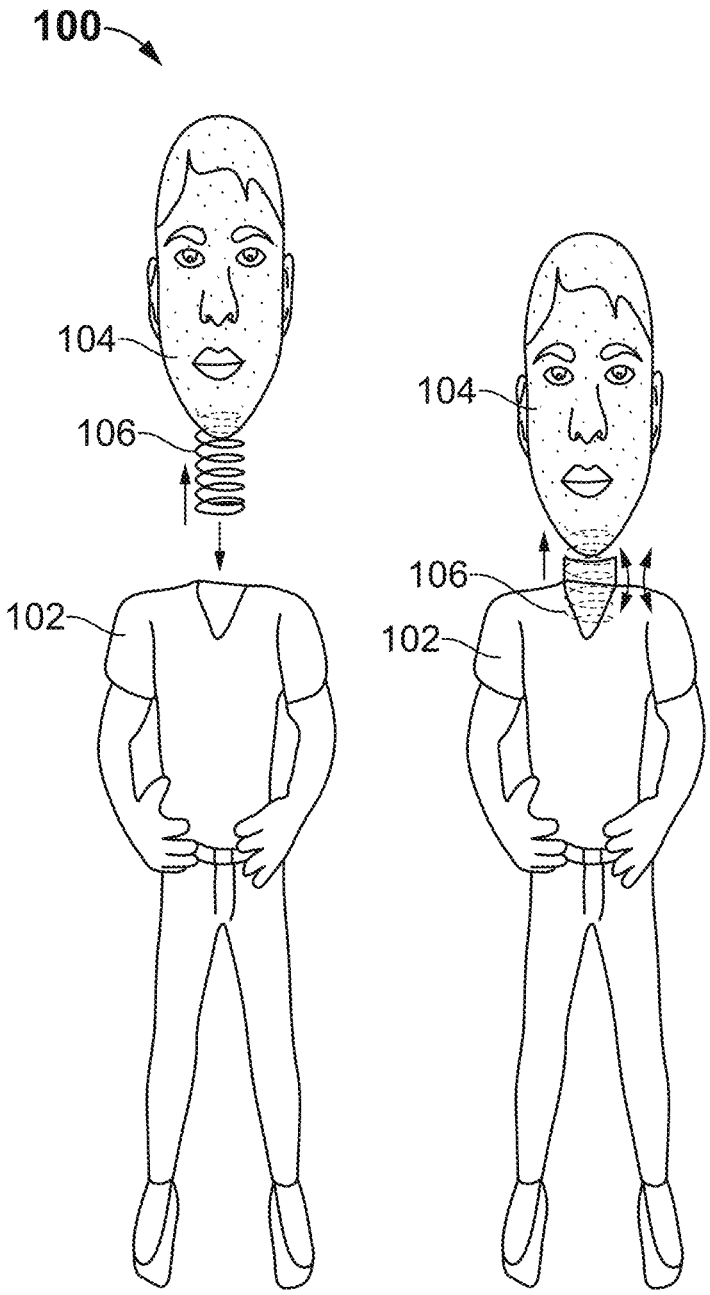
FIG. 1 illustrates a conventional bobbling apparatus.
Figure 2:
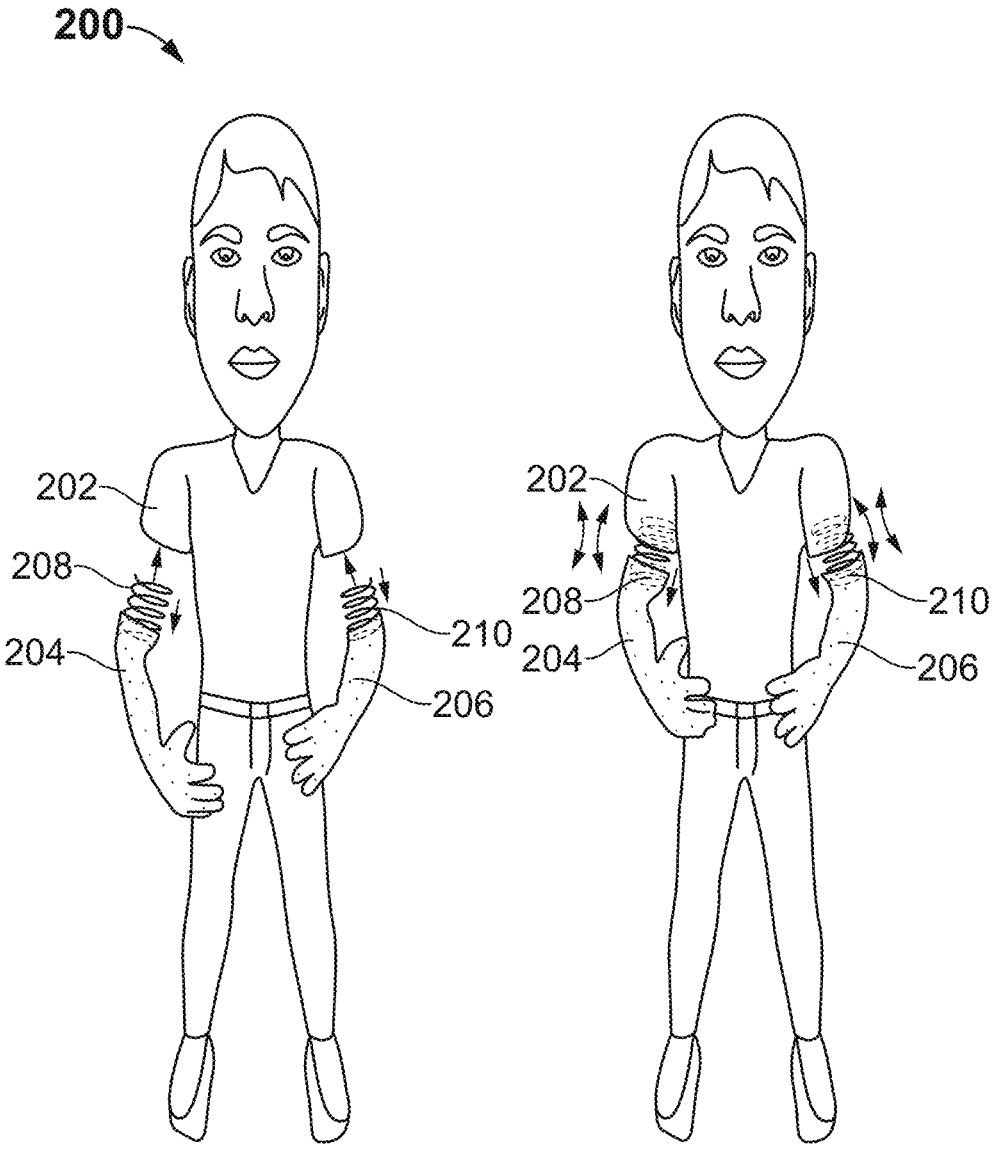
FIG. 2 illustrates another conventional bobbling apparatus.

A description of embodiments of the present invention will now be given with reference to the Figures. It is expected that the present invention may be embodied in other specific forms without departing from its spirit or essential characteristics. The described embodiments are to be considered in all respects only as explanatory and not restrictive.

Overview

The present disclosure describes an apparatus for facilitating a movement of one or more components of two or more physically connected objects. Further, the present disclosure describes a type of technology that is capable of joining two or more objects to cause a bobbling of two or more components via a variety of mechanical engineering methods including but not limited to springs, conical springs, leaf springs, compression springs, torsional springs, garter springs, coils, hinges, pivots, prismatic joints, prismatic joints, ball-socket joints, and so on. This technology is known as "BobbleTogether Tech." An exemplary embodiment of the disclosed apparatus herein has wide applicability and can be applied to various industries including, but not limited to, toys, jugs, bottles, containers, residential and commercial architecture, furniture and furnishings, automotive vehicles, artwork, instruments, and others. Further, the BobbleTogether Tech is a path-breaking technology and is important to many industries including but not limited to toys, jugs, bottles, containers, residential and commercial architecture, furniture and furnishings, automotive vehicles, artwork, instruments, decoys, etc. Further, the apparatus has the potential to revolutionize various industries including but not limited to toys, jugs, bottles, containers, residential and commercial architecture, furniture and furnishings, automotive vehicles, artwork, instruments, decoys, etc. The apparatus has broad utility and application.

The functional aspects of the apparatus can be applied to various industries including but not limited to toys, plastic containers, water bottles, molds, and others. Generally, in the bobble doll market and toy market, the primary benefits of bobbling together are things like enjoyment, amusement, cuteness, etc. In other industries including architecture and automotive vehicles, benefits may be vastly different-to include various forms of aesthetic and practical benefits.

Further, the disclosed apparatus includes a bobbling apparatus. Further, the bobbling apparatus is based on a novel type of technology that can be used in designing a wide variety of goods and products in many application areas including toys, jugs, bottles, containers, residential and commercial architecture, furniture and furnishings, automotive vehicles, artwork, instruments, decoys, and so on. Further, the disclosed apparatus consists of two or more physical objects. Further, the two or more objects include animate or inanimate figures, two or more non-human living figures, two or more animated character figures, various combinations of human, various combinations of non-human living, various combinations of animated character figures, two or more inanimate objects figures, a combination of human figures and inanimate object figures, a combination of non-human living figure and inanimate object figure, various combinations of human, various combinations of non-human living, various combinations of animated characters, and various combinations of inanimate object figures, etc. Further, for each human or non-human living or animated character figure, and for each inanimate object figure, any part or component of the object may be the part that may connect to itself via a joining module, for example, coil or spring at one end, and physically attach to another figure at the other end.

The "objects" or "figures" have components that are capable of bobbling. Each object may include components with one end connected to the main part of the object via a spring or coil, or by any other means. Further, the other end of components may be physically attached to the ends of the components of the other objects.

Further, the disclosed apparatus is a novel and an original type of bobble apparatus. Further, the disclosed apparatus has wide utility and applicability such as residential and commercial architecture, automotive vehicles, toy industries, etc. Further, the bobbling apparatus may include-two objects (such as two players)-in a particular orientation. Further, the two players may be physically connected at the face of a first player (or Player A) and an end of the arms of a second player (or Player B). Further, Player A's head may be attached to his own body via a mechanism such as a spring or any other means, and Player B's arms may be connected to his own body via springs. Further, the two players' body parts may bobble in unison—the head of Player A and the arms of Player B may "BobbleTogether." Further, in addition to the typical configuration of the bobbling apparatus, an action may also be depicted. Further, none of the existing prior art in the area "joins" two or more bobble objects (or even other types of dolls for that matter) through the manner used in the BobbleTogether Tech.

Further, the BobbleTogether Tech introduces a novel method of producing the bobbling apparatus (or bobble objects), which may also be used for manufacturing items of everyday use in other classes of products. Further, the BobbleTogether Tech may be developed specifically for the bobbling apparatus (such as "bobble dolls"). Further, the disclosed apparatus may be used for 'attaching' or 'joining' in the configuration described in any two or more physical objects. The disclosed apparatus has wide applicability and can be used for attaching, using the configuration described, any type of objects including but not limited to toys, jugs, bottles, containers, residential and commercial architecture, furniture and furnishings, automotive vehicles, artwork, instruments, and others. Further, the technology is path-breaking as it has the potential to revolutionize various industries including the toy industry generally and the bobble doll industry specifically.

Further, an unlimited type of dolls and toys can be designed and produced using the BobbleTogether Tech. Further, for instance, mass-produced bobble dolls can be designed using popular sports figures, politicians, historical figures, and celebrities—and custom bobble dolls may be produced for weddings, baby showers, family or friend ceremonies, and many others. For all intents and purposes, the utility of the BobbleTogether Tech extends well-beyond bobble dolls and may be used for making toys, jugs, bottles, containers, residential and commercial architecture, furniture and furnishings, automotive vehicles, artwork, instruments, and others. Further, the disclosed apparatus can be used across a vast array of bobble doll designs. Further, the objects in the disclosed apparatus may be any combination of one or more humans, non-human living things, animated characters, and inanimate objects. Further, each object in the disclosed apparatus may include one or more components that may be attached to its respective main part via a coil(s) or spring(s), and thus capable of wobbling or bobbling. Further, at the other end of each of the objects comprises bobble-capable components, the objects in the disclosed apparatus may be physically attached. Further, the effect may be the disclosed apparatus with two or more objects that "bobble together." Further, the Bobble Together Tech enables new categories of bobble dolls to be designed with two or more objects that may include a relationship-physically attached and bobbling together in unison in a synergistic way.

Further, for any object (or figure), various components (e.g., a foot) may bobble. Further, for any figure, the figure may include more than one component that may be bobbling. Further, for any figure, various components (e.g., a foot) may be bobbling. Further, in an example, the design and structure of the disclosed apparatus comprising of two human figures may be capable of being attached to the body by a coil or an axis and the head of the first figure and the arms of the second figure are capable of bobbling.

Further, the mechanical engineering methods used to cause bobbling, including but not limited to springs, conical springs, leaf springs, compression springs, torsional springs, garter springs, coils, hinges, pivots, prismatic joints, prismatic joints, ball-socket joints, and so on, may be oriented (in 3D space) to facilitate the primary direction desired for the "bobble." Further, an example may be considered wherein the objects represent a design with Boxer A and Boxer B, with Boxer A landing a left jab into the face of Boxer B. Further, the primary direction of the bobble for Boxer A's arm may be to move straight into Boxer B's face, so the primary bobbling motion may be the head of Boxer B snapping back.

Further, the spring extending out of Boxer A's shoulder and attached to Boxer A's arm may be installed in the direction of the desired arm motion. Further, the primary direction desired of the bobble for Boxer B's head may also be to snap back. Further, the spring coming out of Boxer B's head and into Boxer B's neck may not be vertically oriented (as it is in a typical bobblehead). Instead, it may be at an angle: closer to Boxer A where the spring attaches to the neck, and further back where it attaches to Boxer B's head. In a further embodiment, Boxer A's arm may be attached to its shoulder socket using an electromagnet system. Further, Boxer B's head may be attached to its neck socket using the electromagnet system.

The programming of the cycling of each of the electromagnets' polarities may be coordinated to produce the bobbling together effect in the direction desired. Further, in some embodiments, the electromagnet system (or mechanism) may produce bobbling in ways other than the continuous reversals of polarity. Further, in an instance, an ordinary bobblehead doll—with a spring between the base of the head and the top of the neck socket may be considered. Further, an electromagnet may be integrated in the neck socket or in bottom part of the spring itself and oriented so that the pole located closest to the head may attract a magnetic component. Further, the magnetic component may be integrated at the base of the head or in the top part of the spring itself and oriented so that the pole closest to the neck may be attracted by the pole of the electromagnet. The magnetic component includes at least one of a ferromagnetic component, permanent magnet, the electromagnet, and a metal component. Further, a programmable electronic control system capable of switching the power on and off may be integrated. Further, the programmable electronic control system may produce a bobbling effect as follows: a) When power is applied, the ordinary magnet may be attracted to the electromagnet. This may force the spring to constrict as the ordinary magnet is pulled towards the electromagnet, and; b) When power is removed, the attraction is eliminated and the spring may revert to its natural (less constricted) state. By employing power on-off cycling, bobbling may be produced.

Further, BobbleTogether Tech may also be used for producing a wide variety of other types of items (for example, containers, sculptures, toys, jugs, and others). Further, the BobbleTogether Tech may be conceived as a way of producing the disclosed apparatus. Further, the Bobble Together Tech may have much wider applicability outside of the bobblehead/bobble doll industry, toys, jugs, bottles, containers, residential and commercial architecture, furniture and furnishings, automotive vehicles, artwork, instruments, decoys, and so on. Further, for any of the objects (such as two players) in the disclosed apparatus, more than one component may be attached to the main object via a spring or any other means.

Further, various methods of attaching the end of the "bobbling" component of one object to the end of another object's bobbling component may exist that may be identified in the application. Further, the bobbling components may become physically attached and may not attach permanently during production, but may be capable of being physically attached by embedding magnets or by other means, for example, Velcro, reusable bonding material, reusable tape, suction cups, etc., at the end of each bobbling component. Further, the bobbling components of one object may be able to "swap" one object for another. Further, with an optional method of attaching two objects, the BobbleTogether Tech may be used to design and produce the disclosed apparatus (or the bobbling apparatus set) with individual objects that each have a bobbling component with a magnetic component embedding at the end. The magnetic component includes at least one of a ferromagnetic component, permanent magnet, the electromagnet, and a metal component. Further, an example may be considered wherein the objects may include people and each person in the bobbling apparatus set (or set) includes individually bobbling arms, and magnetic components embedded in the hands. Further, each person in the set may shake hands with every other person in the set, and bobble together. Further, in an example, Celebrity A with his individually bobbling arm/hand may shake hands with the individually bobbling arms/hands of Celebrity B, Celebrity C, the Celebrity D, Celebrity E, and others in the set.

Further, the BobbleTogether Tech may apply to conventional bobblehead dolls and in other animate and non-animate objects. Further, in some embodiments, the disclosed apparatus may use magnetic components to produce a bobble in any type of the bobble doll on-demand. The magnetic component includes at least one of a ferromagnetic component, permanent magnet, the electromagnet, and a metal component. Further, the magnetic component may be embedded in the disclosed apparatus. Further, the surface of the bobbling apparatus may be at one end of a spring or coil. Further, when powered, by continuously reversing the polarity of the electromagnet, and with an ordinary magnet also employed (for example at the other end of the spring or coil), the two magnets may be attracted, repelled, attracted, repelled, etc. Further, the electromagnet may be battery-powered using a variety of different types of batteries. Further, the battery may be embedded into the disclosed apparatus and may be capable of being replaced. Further, the battery may be recharged using solar power or other types of power capable of recharging the battery. Further, the electromagnet may use line voltage. The electromagnets could be powered by any conventional system and method. Further, the electromagnet may be programmable in a variety of ways. Further, in an example, the electromagnet may be set to cause bobbling for x seconds or minutes' bobble, every X seconds or minutes. Further, in some embodiments, the electromagnet may be configured to generate bobbling for conventional bobblehead dolls and in other non-Bobble Together areas.

Referring to FIG. 3 to FIG. 6, the apparatus (300, 500, 600) comprises one or more objects (302, 304). Each object (302, 304) comprises one or more bobbling components (306, 308). The one or more objects (302, 304) comprise a first object 302 and a second object 304. The first object 302 comprises at least one first bobbling component 306 and the second object 304 comprises at least one second bobbling component 308. The apparatus 300 further comprises one or more joining modules (310, 312). The joining module refers to the module that enables the movement of the bobbling components connected to the object. In one embodiment, the joining module comprises one or more components selected from a group comprising, a spring, a conical spring, a leaf spring, a compression spring, a torsional spring, a garter spring, a hinge joint, a pivot joint, a prismatic joint, a ball-socket joint, a hook and loop component, and a conical component. The joining modules (310, 312) comprise a first joining module 310, and a second joining module 312. The first bobbling component 306 is attached to the first object 302 via the first joining module 310 and the second bobbling component 308 is attached to the second object 304 via the second joining module 312.

The first joining module 310 is configured to bobble the first bobbling component 306 in a predefined direction of motion. In one embodiment, the first joining module 310 could be configured to bobble the first bobbling component 306 in any desired direction of motion. The direction of motion includes an axis of motion.

Further, the second joining module 312 is configured to bobble the second bobbling component 308 in a predefined direction of motion. In one embodiment, the second joining module 312 could be configured to bobble the second bobbling component 308 in any desired direction of motion. The direction of motion includes an axis of motion. The first joining module 310, the second joining module 312, and the connected at least two bobbling components (306, 308) enable the bobbling components (306, 308) to synergistically bobble in unison.

Figure 3:
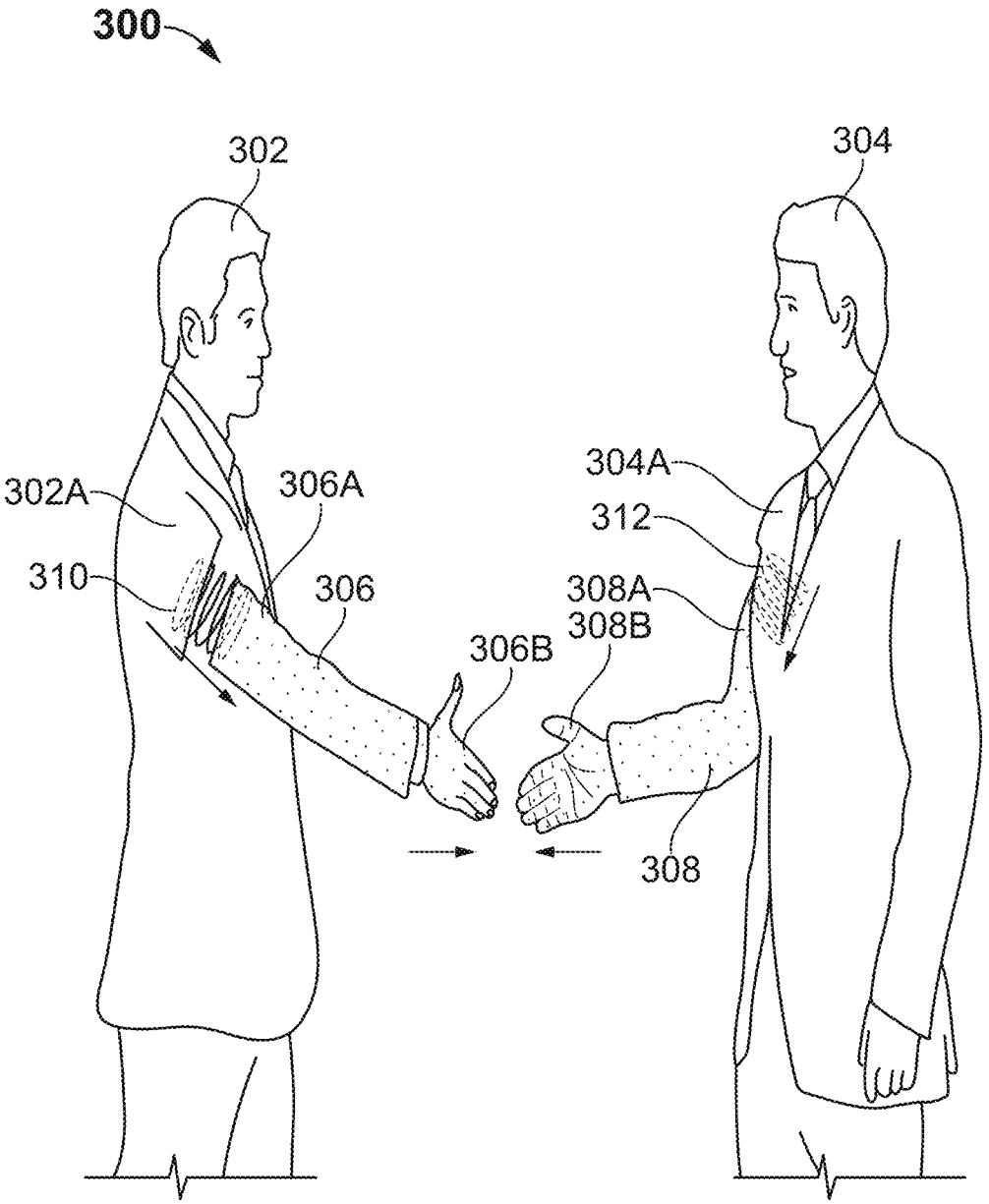
FIG. 3 exemplarily illustrates an articulating apparatus comprising two human figures approaching for a handshake, according to an embodiment of the present invention.
Figure 4:
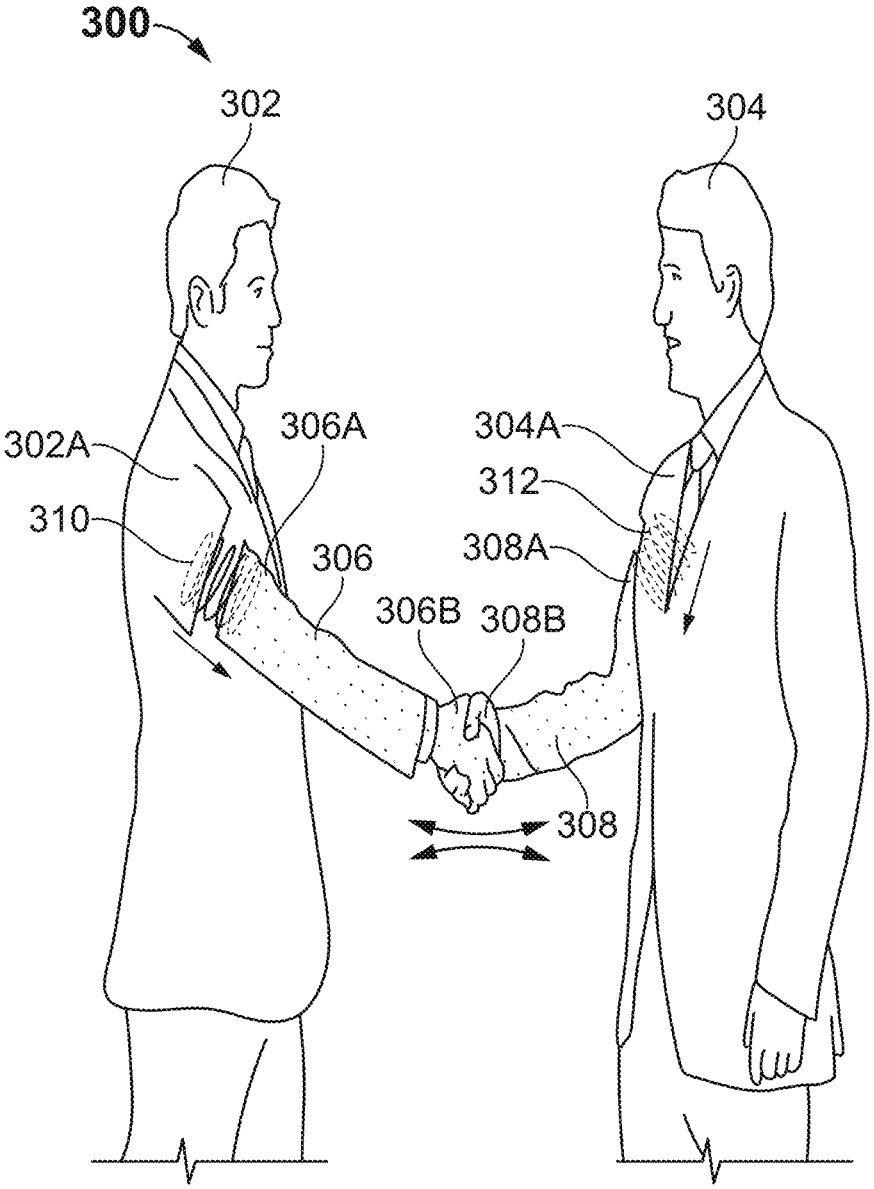
FIG. 4 exemplarily illustrates the articulating apparatus of FIG. 3 comprising two human figures performing a handshake.

Referring to FIG. 3, the first bobbling component 306 is separated from the second bobbling component 308. Referring to FIG. 4, the first bobbling component 306 is connected to the second bobbling component 308. In one embodiment, the first bobbling component 306 is integrally connected to the second bobbling component 308. In another embodiment, the first bobbling component 306 is detachably connected to the second bobbling component 308.

Figure 5:
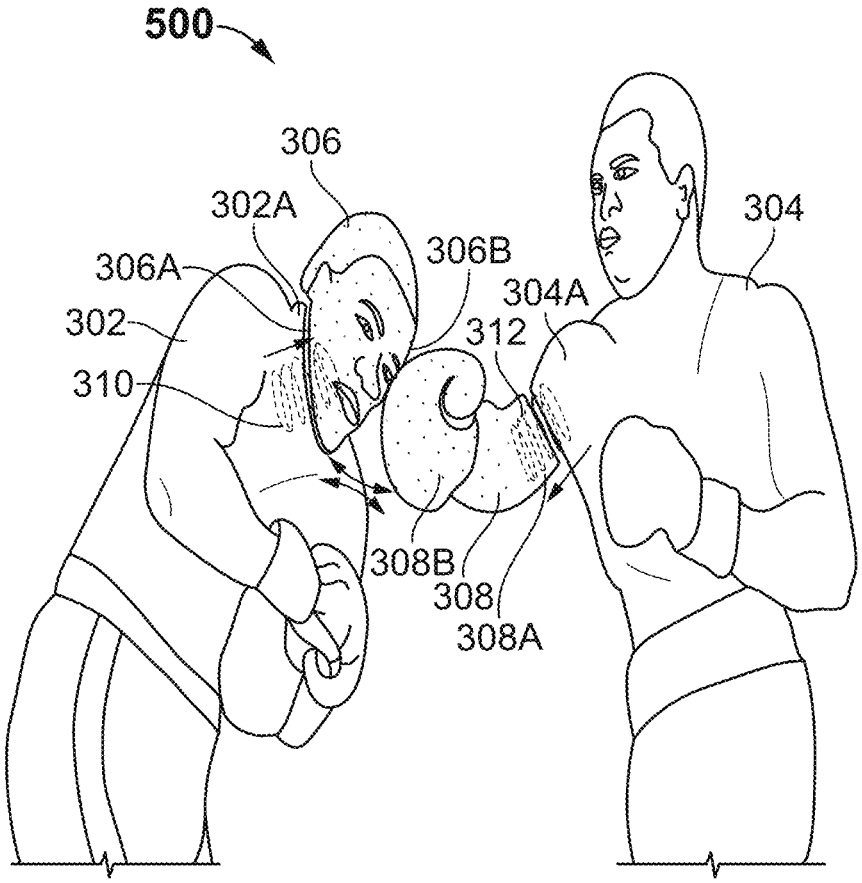
FIG. 5 exemplarily illustrates an articulating apparatus comprising two human figures performing boxing, according to another embodiment of the present invention.
Figure 6:
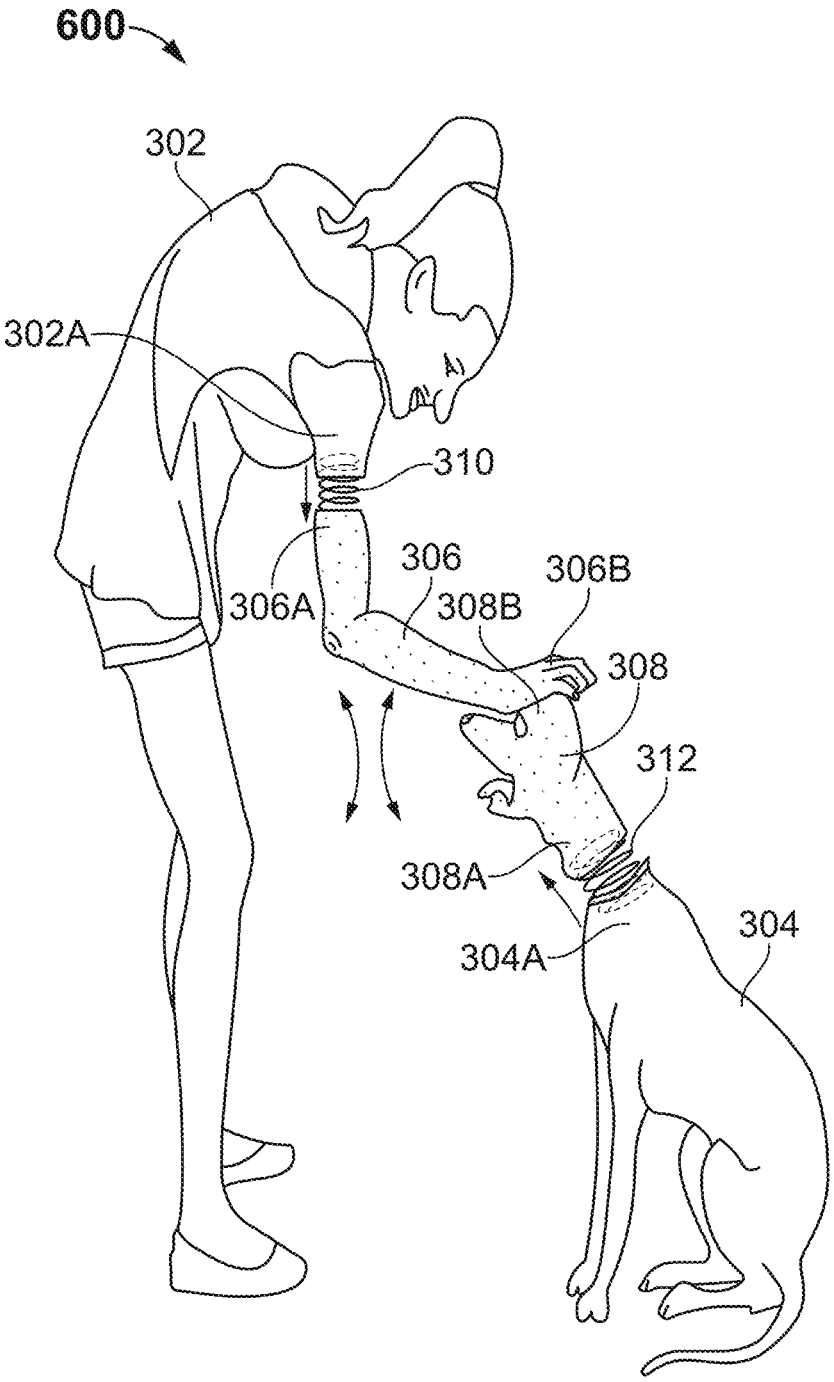
FIG. 6 exemplarily illustrates an articulating apparatus comprising a human figure petting a dog figure, according to yet another embodiment of the present invention.

Referring to FIG. 4 to FIG. 6, the first bobbling component 306 comprises a first end 306A and a second end 306B. Further, the second bobbling component 308 comprises a first end 308A and a second end 308B. The first end 306A of the first bobbling component 306 is connected to a first end 302A of the first object 302. The first end 308A of the second bobbling component 308 is connected to a first end 304A of the second object 304. The second end 306B of the first bobbling component 306 is connected to the second end 308B of the second bobbling component 308. In one embodiment, the second end 306B of the first bobbling component 306 is integrally connected to the second end 308B of the second bobbling component 308.

In one embodiment, the first end 306A of the first bobbling component 306 is connected to the first end 302A of the first object 302 via the first joining module 310. Further, the first end 308A of the second bobbling component 308 is connected to the first end 304A of the second object 304 via the second joining module 312.

Referring to FIG. 3 and FIG. 4, in one embodiment, the first object 302 is a first human figure and the second object 304 is a second human figure. In one embodiment, the first bobbling component 306 is a first limb connected to the first human figure via the first joining module 310 and the second bobbling component 308 is a second limb connected to the second human figure via the second joining module 312. Referring to FIG. 4, the first limb of the first human figure is connected to the second limb of the second human figure.

Referring to FIG. 5, the first object 302 is a first human figure and the second object 304 is a second human figure. The first bobbling component 306 is a head of the first human figure. The second bobbling component 308 is a limb of the second bobbling component 308. The head is connected to the first human figure via the first joining module 310 and the limb is connected to the second human figure via the second joining module 312. The limb of the second human FIG. 312 is attached to the head of the first human figure depicting a boxing action.

Referring to FIG. 6, the first object 302 is a female human figure and the second object 304 is a dog figure. The first bobbling component 306 is a first limb of the female human figure. The second bobbling component 308 is a head of the dog figure. The first limb is connected to the female human figure via the first joining module 310 and the head is connected to the dog figure via the second joining module 312. The limb of the human female figure is connected to the head of the dog figure. In one embodiment, the limb of the human female figure is integrally connected to the head of the dog figure.

In one embodiment, the joining modules (310, 312) comprises one or more components selected from a group including, but not limited to, a spring, a conical spring, a leaf spring, a compression spring, a torsional spring, a garter spring, a hinge joint, a pivot joint, a prismatic joint, an electromechanical device and a ball-socket joint. The electromechanical device including, but not limited to, electric motor, solenoid, and electromagnet. Further, the first bobbling component 306 is detachably connected to the second bobbling component 308 via at least one of a Velcro® type fastener, one or more magnets one or more electromagnets, a snap fastener, a reusable bonding material, a reusable tape, and suction cups. In another embodiment, the first bobbling component 306 is permanently connected to the second bobbling component 308 via one or more bonding material. In yet another embodiment, the first bobbling component 306 are connected to the second bobbling component 308 via one or more connecting modules. The connecting modules comprises one or more components selected from a group comprising one or more magnets, one or more electromagnets, a Velcro® fastener, a snap fastener, a reusable bonding material, a reusable tape, suction cups and an electromechanical device. The electromechanical device includes, but not limited to, electric motor, solenoid and electromagnet.

Figure 7:
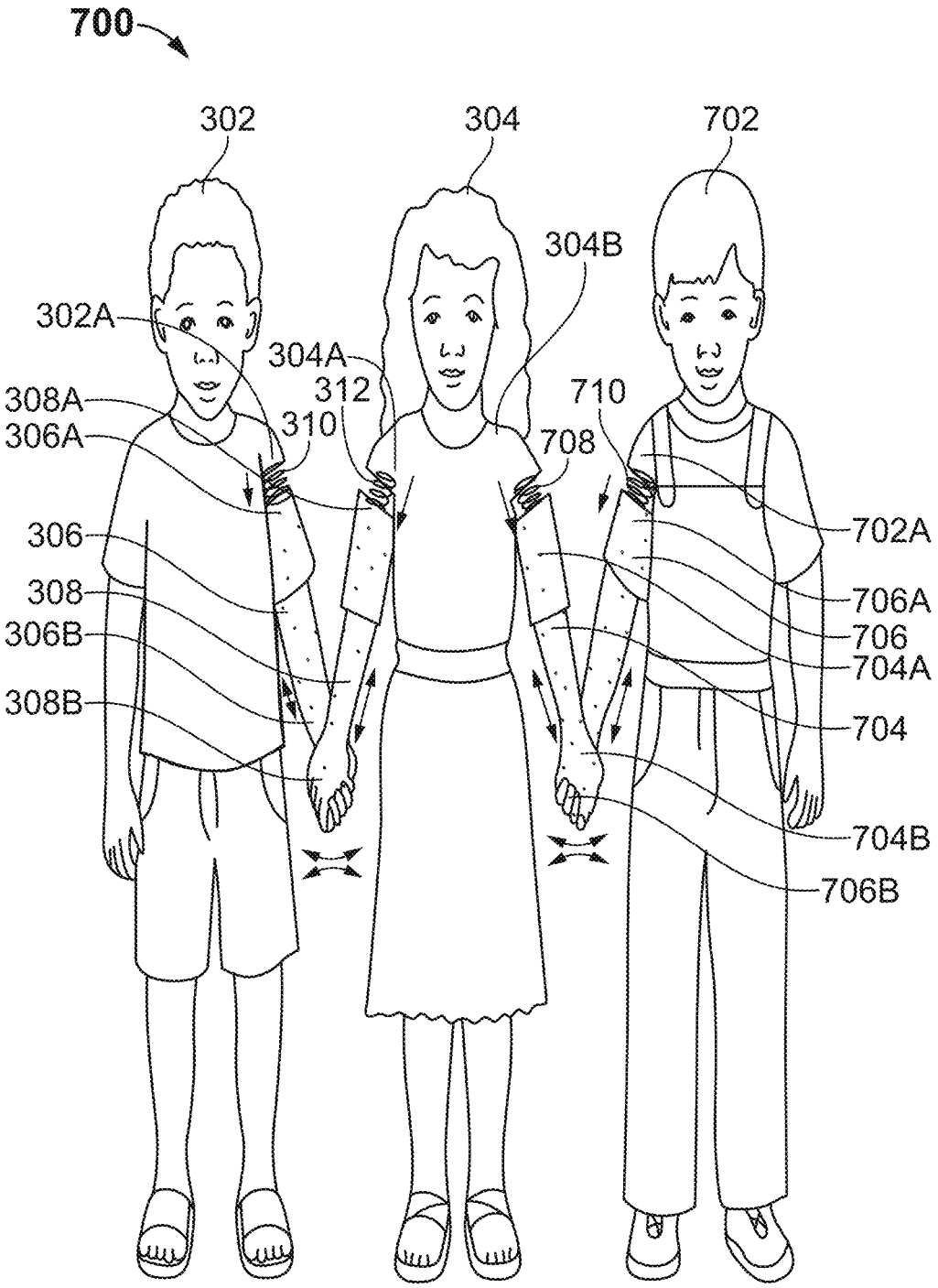
FIG. 7 exemplarily illustrates an articulating apparatus comprising three human figures holding hands, according to yet another embodiment of the present invention.
Figure 8:
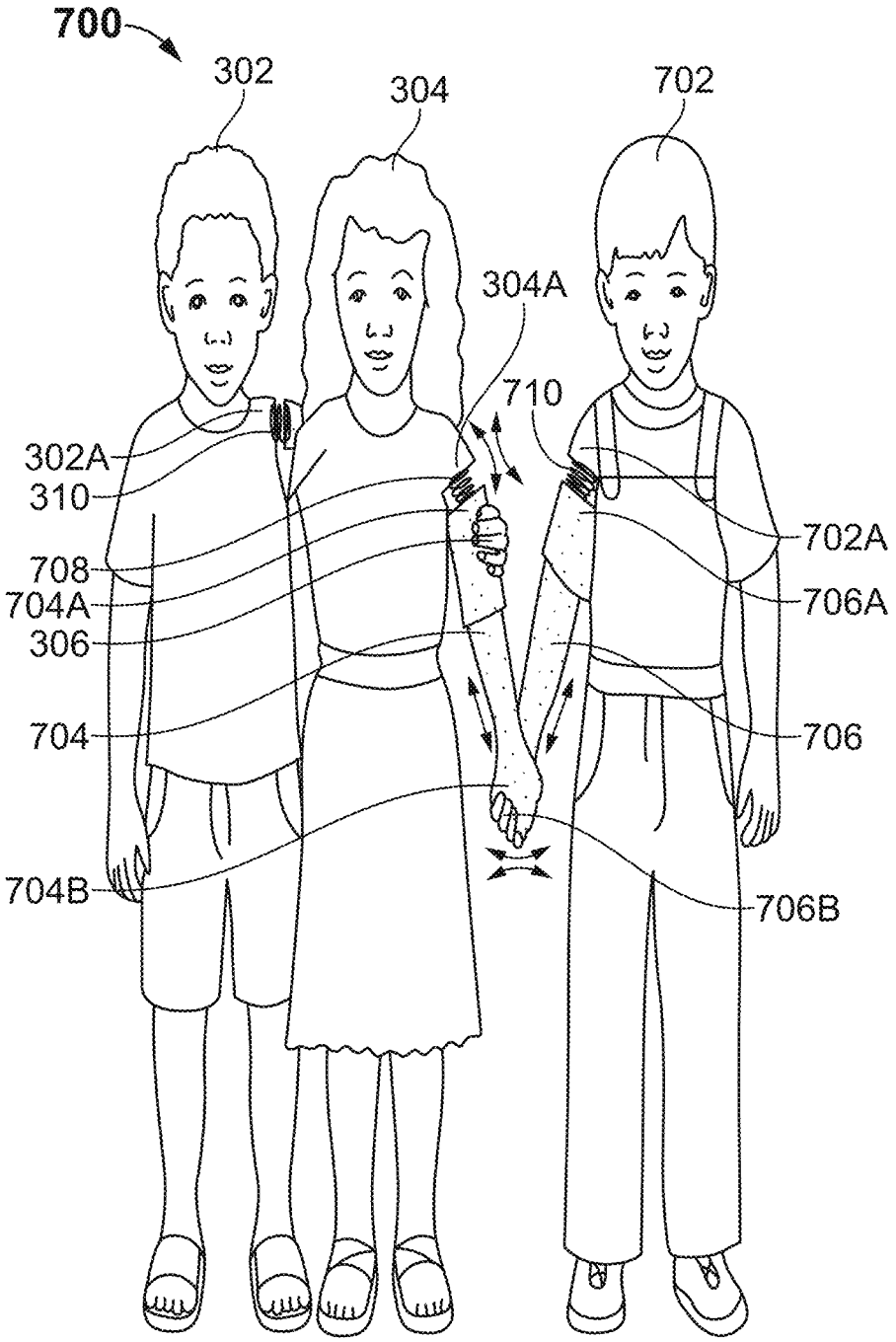
FIG. 8 exemplarily illustrates an articulating apparatus comprising three human figures, where two human figures are holding hands and one human figure is putting an arm around another human figure's shoulder, according to yet another embodiment of the present invention.

Referring to FIG. 7 and FIG. 8, an apparatus 700 comprises one or more objects (302, 304, 702). Each object (302, 304, 702) comprises one or more bobbling components (306, 308, 704, 706). The one or more objects (302, 304, 702) comprises a first object 302, a second object 304 and a third object 702. The first object 302 comprises a first bobbling component 306, the second object 304 comprises at least two second bobbling components (308, 704) and the third object 702 comprises a third bobbling component 706. In one embodiment, the first object 302 is a first human figure, the second object 304 is a second human figure and the third object 702 is a third human figure. Further, each bobbling component (306, 308, 704, 706) is a limb of the respective human figure.

The apparatus 700 further comprises one or more joining modules (310, 312, 708, 710). The joining modules (310, 312, 708, 710) comprises a first joining module 310, at least two second joining module (312, 708) and the third joining module 710. The first joining module 310 is configured to connect the first bobbling object 306 to the first object 302. At least two second joining modules (312, 708) are configured to connect at least two second bobbling components (308, 704), respectively, to the second object 304. The third joining module 710 is configured to connect the third bobbling object 706 to the third object 702.

Referring to FIG. 7, at least one second bobbling component 308 is connected to the first bobbling component 306 and at least another second bobbling component 704 is connected to the third bobbling component 706. In one embodiment, at least one second bobbling component 308 is integrally connected to the first bobbling component 306 and at least another second bobbling component 704 is integrally connected to the third bobbling component 706.

Referring to FIG. 8, the first bobbling component 306 of the first object 302 is attached to the second bobbling component 310. Further, the second bobbling component 704 of the second object 304 is attached to the third bobbling component 706 of the third object 702. In one embodiment, the first bobbling component 306 of the first object 302 is integrally attached to the second bobbling component 310 and the second bobbling component 704 of the second object 304 is integrally attached to the third bobbling component 706 of the third object 702.

The first joining module 310 is configured to bobble the first bobbling component 306 in a predefined direction of motion. In one embodiment, the first joining module 310 could be configured to bobble the first bobbling component 306 in any desired direction of motion The direction of motion includes an axis of motion.

Further, the second joining modules (312, 708) are configured to bobble the second bobbling component (308, 704) in a predefined direction of motion. In one embodiment, the second joining modules (312,708) could be configured to bobble the second bobbling components (308, 704) in any desired direction of motion The direction of motion includes an axis of motion.

The third joining module 710 is configured to bobble the third bobbling component 706 in a predefined direction of motion. In one embodiment, the third joining module 710 could be configured to bobble the third bobbling component 706 in any desired direction of motion The direction of motion includes an axis of motion.

The first joining module 310, the second joining modules (312, 708), the third joining module 710, and the connected two or more bobbling components (306, 308, 704, 706) enables the bobbling components (306, 308, 704, 706) to synergistically bobble in unison.

Still referring to FIG. 7, the first bobbling component 306 comprises a first end 306A and a second end 306B. Further, the second bobbling component 308 comprises a first end 308A and a second end 308B. Another second bobbling component 704 comprises a first end 704A and a second end 704B. Further, the third bobbling component 706 comprises a first end 706A and a second end 706B.

The first end 306A of the first bobbling component 306 is connected to a first end 302A of the first object 302 via the first joining module 310. The first end 308A of the second bobbling component 308 is connected to a first end 304A of the second object 304 via the second joining module 312. The first end 704A of another second bobbling component 704 is connected to a second end 304B of the second object 304 via another second joining module 708. Further, the first end 706A of the third bobbling component 706 is connected to a first end 702A of the third object 702 via the third joining module 710.

The second end 308B of the second bobbling component 308 is connected to the second end 306B of the first bobbling component 306. Further, the second end 704B of another second bobbling component 704 is connected to the second end 706B of the third bobbling component 706. The first joining module 310, the second joining module 312, and the connected bobbling components (306, 308) enable the bobbling components (306, 308) to synergistically bobble in unison. The third joining module 710, another second joining module 708, and the connected bobbling components (704, 706) enable the bobbling components (704, 706) to synergistically bobble in unison.

Referring to FIG. 8, the first bobbling component 306 comprises a first end 306A and a second end 306B and the second bobbling component 704 comprises a first end 704A and a second end 704B. Further, the third bobbling component 706 comprises a first end 706A and a second end 706B.

The first end 306A of the first bobbling component 306 is connected to a first end 302A of the first object 302 via the first joining module 310. The first end 704A of the second bobbling component 704 is connected to a second end 304B of the second object 304 via the second joining module 708. Further, the first end 706A of the third bobbling component 706 is connected to a first end 702A of the third object 702 via the third joining module 710.

The second end 306B of the first bobbling component 306 is connected to the first end 704A of the second bobbling component 704, and the second end 704B of the second bobbling component 704 is connected to the second end 706B of the third bobbling component 706. The first joining module 310, the second joining module 704, and the connected bobbling components (306, 704) are configured to enable the connected bobbling components (306, 704) to bobble synergistically in unison. The second joining module 704, the third joining module 710, and the connected bobbling components (704, 706) are configured to enable the connected bobbling components (706, 704) to bobble synergistically in unison.

In one embodiment, the joining modules (310, 312) comprises one or more components selected from a group including, but not limited to, a spring, a conical spring, a leaf spring, a compression spring, a torsional spring, a garter spring, a hinge joint, a pivot joint, a prismatic joint, and a ball-socket joint. Further, the bobbling components (306, 308, 704, 706) could be detachably connected to one another via a Velcro® type fastener, one or more magnets and one or more electromagnets. In another embodiment, the bobbling components (306, 308, 704, 706) could be permanently connected via one or more bonding materials. In yet another embodiment, the bobbling components (306, 308, 704, 706) could be connected via one or more connecting modules. The connecting modules comprises one or more components selected from a group comprising one or more magnets, one or more electromagnets, a Velcro® fastener, a snap fastener, a reusable bonding material, a reusable tape, suction cups and an electromechanical device. The electromechanical device includes, but not limited to, electric motor, solenoid and electromagnet.

Figure 9:
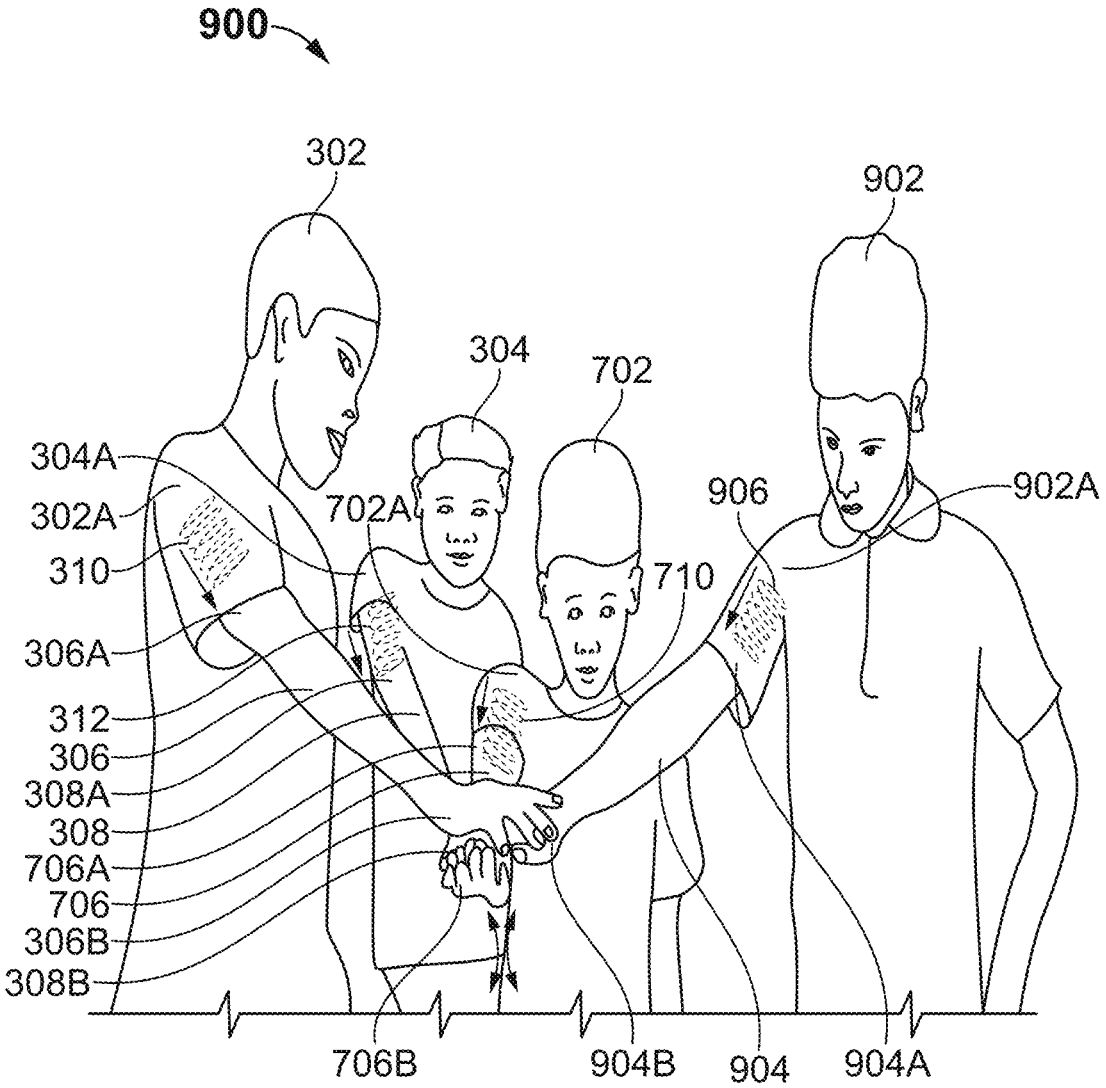
FIG. 9 exemplarily illustrates an articulating apparatus comprising four human figures joining hands together, according to yet another embodiment of the present invention.

Referring to FIG. 9, the apparatus 900 comprises one or more objects (302, 304, 702, 902). Each object (302,304, 702, 902) comprises one or more bobbling components (306, 308, 706, 904). The one or more objects (302,304,702, 902) comprises a first object 302, a second object 304, a third object 702 and a fourth object 902. The first object 302 comprises at least one first bobbling component 306, the second object 304 comprises at least one second bobbling component 308, the third object 702 comprises at least one third bobbling component 706 and the fourth object 902 comprises at least one fourth bobbling component 904. In one embodiment, each object (302,304,702, 902) is a human figure and each bobbling component (306, 308, 706, 904) is a limb of the respective human figure.

The apparatus 900 further comprises one or more joining modules (310, 312, 710, 906). The joining modules comprises a first joining module 310, a second joining module 312, a third joining module 710, and a fourth joining module 906. The first joining module 310 is configured to connect the first bobbling component 306 to the first object 302, the second joining module 312 is configured to connect the second bobbling component 308 to the second object 304, the third joining module 710 is configured to connect the third bobbling component 706 to the third object 702 and the fourth joining module 906 is configured to connect the fourth bobbling component 904 to the fourth object 902.

The first bobbling component 306, the second bobbling component 308, the third bobbling component 706, the fourth bobbling component 904 are connected together. In one embodiment, the first bobbling component 306, the second bobbling component 308, the third bobbling component 706, the fourth bobbling component 904 are integrally connected together. In further embodiment, the first bobbling component 306, the second bobbling component 308, the third bobbling component 706, the fourth bobbling component 904 are detachably connected together.

The first joining module 310 is configured to move the first bobbling component 306 in a predefined direction of motion. In one embodiment, the first joining module 310 could be configured to bobble the first bobbling component 306 in any desired direction of motion. The direction of motion includes an axis of motion.

Further, the second joining module 312 is configured to move the second bobbling component 308 in a predefined direction of motion. In one embodiment, the second joining module 312 could be configured to bobble the second bobbling component 308 in any desired direction of motion The direction of motion includes an axis of motion.

Further, the third joining module 710 is configured to move the third bobbling component 706 in a predefined direction of motion. In one embodiment, the third joining module 710 could be configured to bobble the third bobbling component 706 in any desired direction of motion The direction of motion includes an axis of motion.

Further, the fourth joining module 906 is configured to move the fourth bobbling component 904 in a predefined direction of motion. In one embodiment, the fourth joining module 906 could be configured to bobble the fourth bobbling component 904 in any desired direction of motion The direction of motion includes an axis of motion. The first joining module 310, the second joining module 312, the third joining module 710, and the fourth joining module 906 and the connected two or more bobbling components (306, 308, 706, 904) enables the bobbling components (306, 308, 706, 904) to synergistically bobble in unison.

Still referring to FIG. 9, the first bobbling component 306 comprises a first end 306A and a second end 306B. Further, the second bobbling component 308 comprises a first end 308A and a second end 308B. Further, the third bobbling component 706 comprises a first end 706A and a second end 706B. Further, the fourth bobbling component 904 comprises a first end 904A and a second end 904B.

The first end 306A of the first bobbling component 306 is connected to a first end 302A of the first object 302 via the first joining module 310. The first end 308A of the second bobbling component 308 is connected to a first end 304A of the second object 304 via the second joining module 312. The first end 706A of the third bobbling component 706 is connected to a second end 706B of the third object 702 via the third joining module 710. Further, the first end 904A of the fourth bobbling component 904 is connected to a first end 904A of the fourth object 902 via the fourth joining module 906.

The second end 306B of the first bobbling component 306, second end 308B of the second bobbling component 308, the second end 706B of the third bobbling component 706, the second end 904B of the fourth bobbling component 904 are connected together. The first joining module 310, the second joining module 312, the third joining module 710, the fourth joining module 906 and the connected bobbling components (306, 308, 706, 904) enable the connected bobbling components (306, 308,706, 904) to synergistically bobble in unison.

Figure 10:
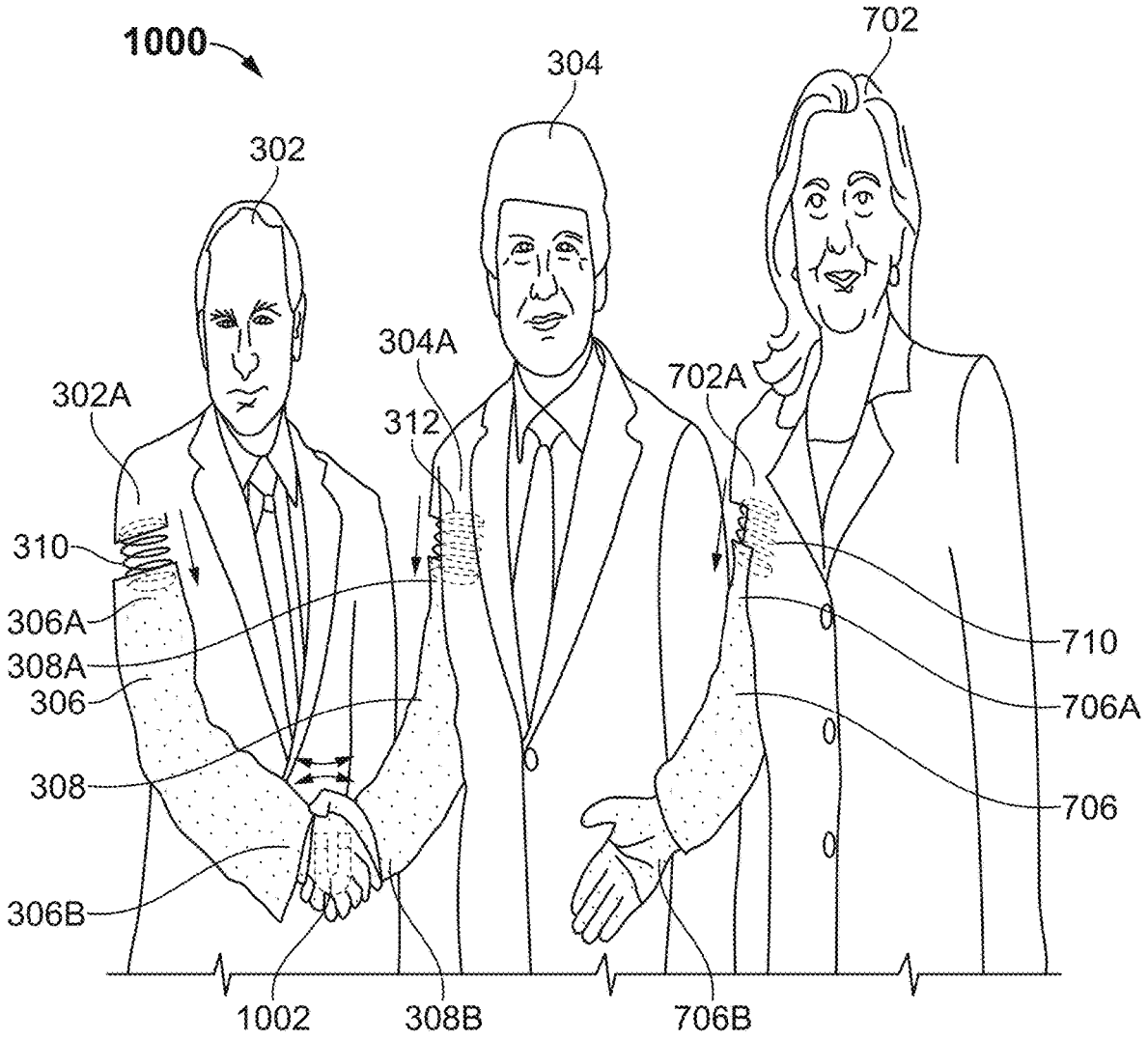
FIG. 10 exemplarily illustrates an articulating apparatus comprising a set of human figures in which two figures are shaking hands, according to yet another embodiment of the present invention.

Referring to FIG. 10, the apparatus 1000 comprises one or more objects (302, 304, 702). Each object (302,304,702) comprises one or more bobbling components (306, 308, 706). The one or more objects (302,304,702) comprises a first object 302, a second object 304, a third object 702. The first object 302 comprises at least one first bobbling component 306, the second object 304 comprises at least one second bobbling component 308, the third object 702 comprises at least one third bobbling component 706. In one embodiment, each object (302,304,702) is a human figure and each bobbling component (306, 308, 706) is a limb of the respective human figure.

The apparatus 1000 further comprises one or more joining modules (310, 312, 710). The joining modules comprises a first joining module 310, a second joining module 312, and a third joining module 710. The first joining module 310 is configured to connect the first bobbling component 306 to the first object 302, the second joining module 312 is configured to connect the second bobbling component 308 to the second object 304, and the third joining module 710 is configured to connect the third bobbling component 706 to the third object 702.

The second bobbling component 308 of the second object 304 is connected to the first bobbling component 306 of the first object 302. In one embodiment, the second bobbling component 308 of the second object 304 is detachably connected to the first bobbling component 306 of the first object 302. The bobbling components (306,308,706) could be detachably connected to one another via one or more magnets 1002. The first joining module 310 is configured to bobble the first bobbling component 306 in a predefined direction of motion. In one embodiment, the first joining module 310 could be configured to bobble the first bobbling component 306 in any desired direction of motion The direction of motion includes an axis of motion.

Further, the second joining module 312 is configured to bobble the second bobbling component 308 in a predefined direction of motion. In one embodiment, the second joining module 312 could be configured to bobble the second bobbling component 308 in any desired direction of motion. The direction of motion includes an axis of motion. Further, the third joining module 710 is configured to bobble the third bobbling component 706 in a predefined direction of motion. In one embodiment, the third joining module 710 could be configured to bobble the third bobbling component 706 in any desired direction of motion. The direction of motion includes an axis of motion.

The first joining module 310, the second joining module 312, and the connected bobbling components (306,308) enable the bobbling components (306,308) to synergistically bobble in unison. The first bobbling component 306 comprises a first end 306A and a second end 306B. Further, the second bobbling component 308 comprises a first end 308A and a second end 308B. Further, the third bobbling component 706 comprises a first end 706A and a second end 706B. The first end 306A of the first bobbling component 306 is connected to a first end 302A of the first object 302 via the first joining module 310. The first end 308A of the second bobbling component 308 is connected to a first end 304A of the second object 304 via the second joining module 312. The first end 706A of the third bobbling component 706 is connected to a second end 706B of the third object 702 via the third joining module 710.

The second end 306B of the first bobbling component 306 is connected to the second end 308B of the second bobbling component 308. The first joining module 310, the second joining module 312, and the connected bobbling components (306, 308) enables the connected bobbling components (306, 308) to synergistically bobble in unison.

Figure 11:
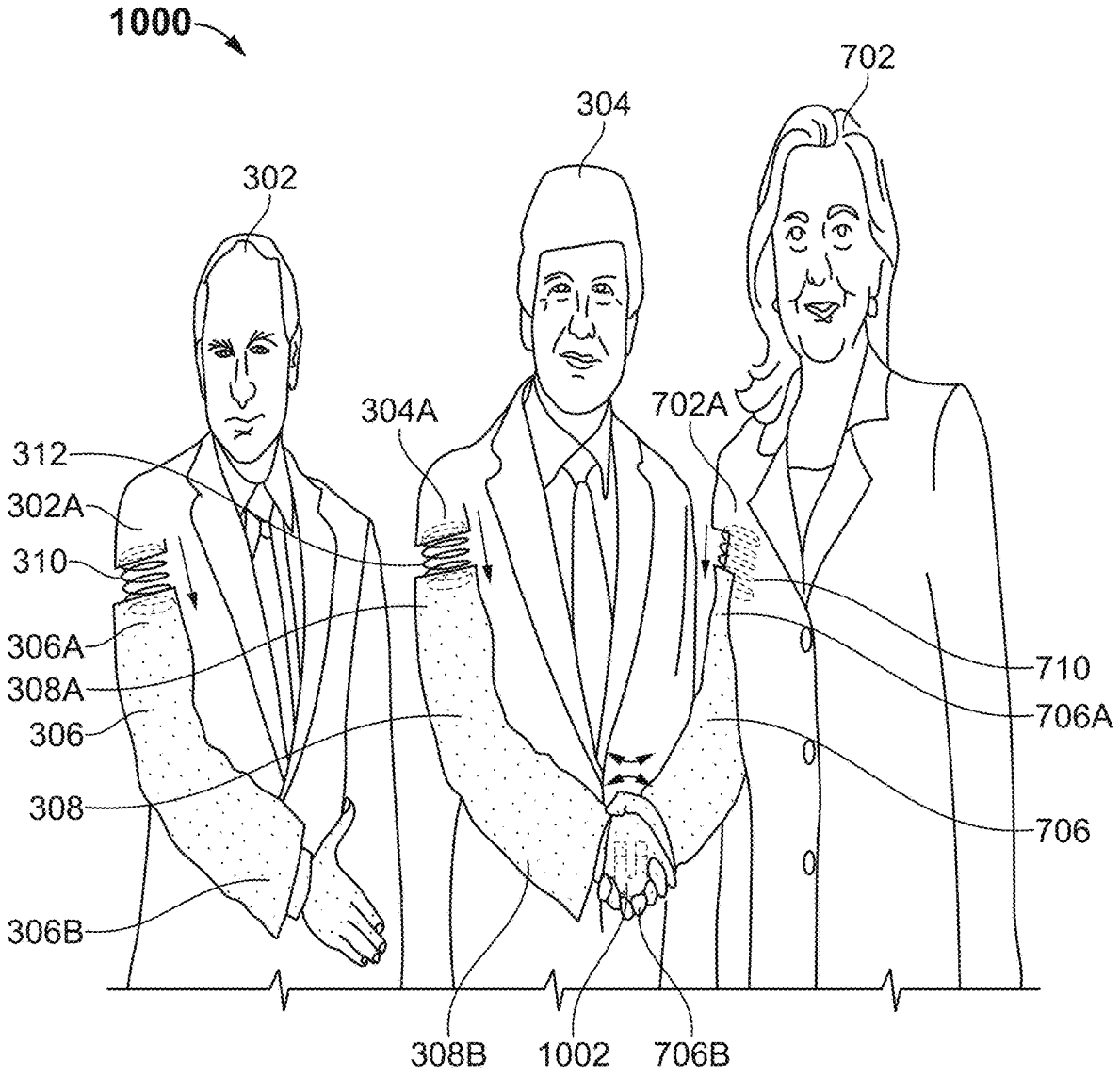
FIG. 11 exemplarily illustrates the articulating apparatus of FIG. 10 comprising the set of human figures in which another two figures are shaking hands, according to yet another embodiment of the present invention.

Referring to FIG. 11, the apparatus 1000 comprises one or more objects (302, 304, 702). Each object (302,304,702) comprises one or more bobbling components (306, 308, 706). The one or more objects (302,304,702) comprises a first object 302, a second object 304, a third object 702. The first object 302 comprises at least one first bobbling component 306, the second object 304 comprises at least one second bobbling component 308, the third object 702 comprises at least one third bobbling component 706. In one embodiment, each object (302,304,702) is a human figure and each bobbling component (306, 308, 706) is a limb of the respective human figure. The apparatus 1000 further comprises one or more joining modules (310, 312, 710). The joining modules comprises a first joining module 310, a second joining module 312, and a third joining module 710. The first joining module 310 is configured to connect the first bobbling component 306 to the first object 302, the second joining module 312 is configured to connect the second bobbling component 308 to the second object 304, and the third joining module 710 is configured to connect the third bobbling component 706 to the third object 702.

The second bobbling component 308 of the second object 304 is connected to the third bobbling component 706 of the third object 702. In one embodiment, the second bobbling component 308 of the second object 304 is detachably connected to the first bobbling component 706 of the third object 702. The bobbling components (306,308,706) could be detachably connected to one another via one or more magnets 1002.

The first joining module 310 is configured to bobble the first bobbling component 306 in a predefined direction of motion. In one embodiment, the first joining module 310 could be configured to bobble the first bobbling component 306 in any desired direction of motion The direction of motion includes an axis of motion. Further, the second joining module 312 is configured to bobble the second bobbling component 308 in a predefined direction of motion. In one embodiment, the second joining module 312 could be configured to bobble the second bobbling component 308 in any desired direction of motion The direction of motion includes an axis of motion.

Further, the third joining module 710 is configured to bobble the third bobbling component 706 in a predefined direction of motion. In one embodiment, the third joining module 710 could be configured to bobble the third bobbling component 706 in any desired direction of motion The direction of motion includes an axis of motion. The second joining module 312, the third joining module 710, and the connected bobbling components (308, 706) enable the bobbling components (308,706) to synergistically bobble in unison.

The first bobbling component 306 comprises a first end 306A and a second end 306B. Further, the second bobbling component 308 comprises a first end 308A and a second end 308B. Further, the third bobbling component 706 comprises a first end 706A and a second end 706B. The first end 306A of the first bobbling component 306 is connected to a first end 302A of the first object 302 via the first joining module 310. The first end 308A of the second bobbling component 308 is connected to a first end 304A of the second object 304 via the second joining module 312. The first end 706A of the third bobbling component 706 is connected to a second end 706B of the third object 702 via the third joining module 710.

The second end 308B of the second bobbling component 308 is connected to the second end 706B of the third bobbling component 706. The second joining module 312, the third joining module 710, and the connected bobbling components (308,706) enable the connected bobbling components (308,706) to synergistically bobble in unison.

Figure 12:
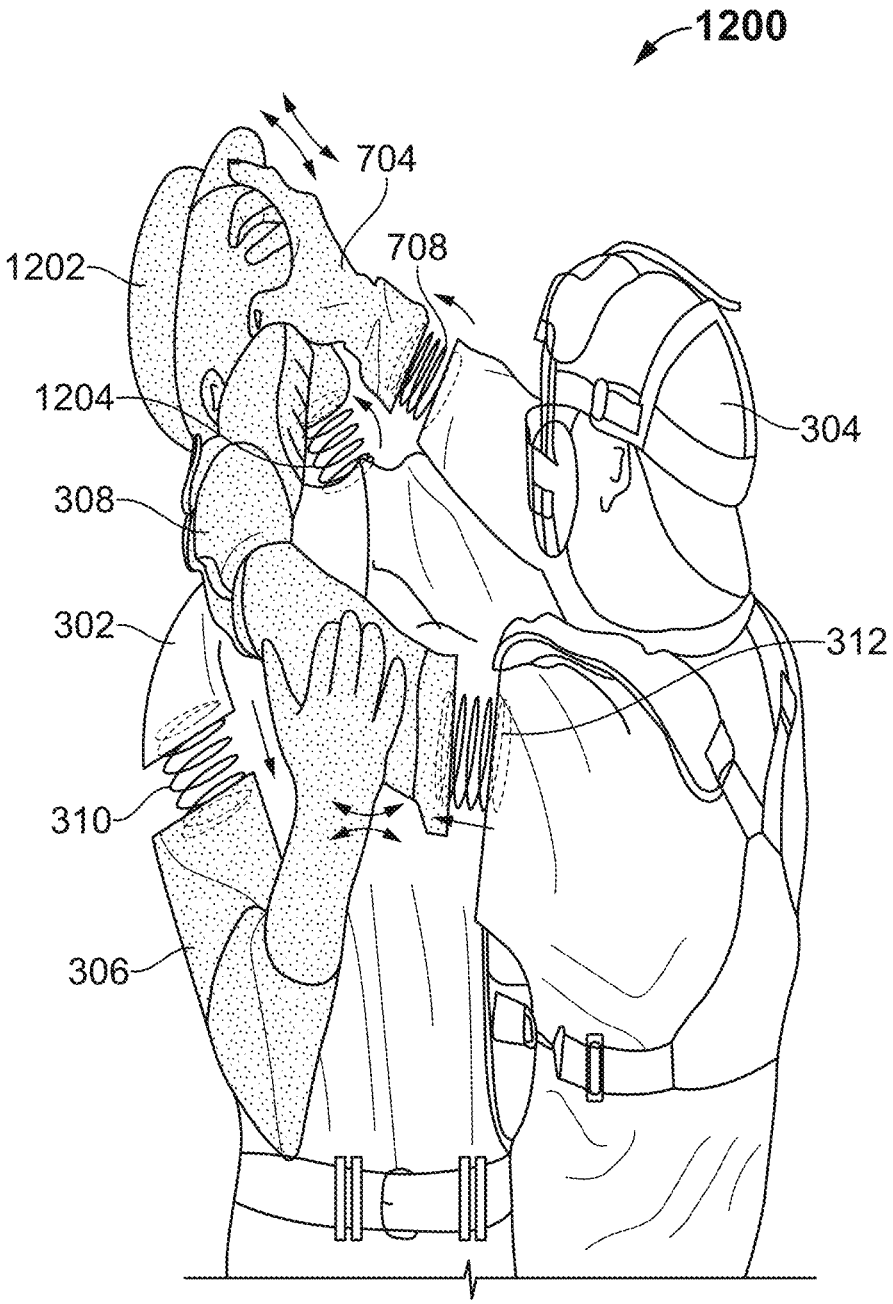
FIG. 12 exemplarily illustrates an articulating apparatus comprising two human figures engaging in a fight, according to yet another embodiment of the present invention.

Referring to FIG. 12, the apparatus 1200 comprises one or more objects (302, 304). Each object (302,304) comprises one or more bobbling components (306, 1202, 308,704). The one or more objects (302,304) comprises a first object 302, and a second object 304. The first object 302 comprises at least one first bobbling component (306, 1202) and the second object 304 comprises at least one second bobbling component (308, 704). In one embodiment, each object (302,304) is a human figure and each bobbling component (306, 1202, 308,708) is a limb or head of the respective human figure.

The apparatus 1200 further comprises one or more joining modules (310, 1204, 312, 708). The joining modules (310, 1204, 312,708) comprises at least two first joining modules (310,1204) and at least two second joining modules (312, 708). The first joining module 310 is configured to connect the first bobbling component 306 to the first object 302, the first joining module 1204 is configured to connect the first bobbling component 1202 to the first object, the second joining module 312 is configured to connect the second bobbling component 308 to the second object 304, the second joining module 708 is configured to connect the second bobbling component 704 to the second object 304.

The second bobbling component 308 of the second object 304 is connected to the first bobbling component 306 of the second object 302. The second bobbling component 704 of the second object 304 is connected to the first bobbling component 1202 of the second object 302. In one embodiment, the second bobbling components (308,704) of the second object 304 is integrally connected to the first bobbling components (306, 1202) of the first object 302. In one embodiment, the second bobbling components (308,704) of the second object 304 is detachably connected to the first bobbling components (306, 1202) of the first object 302.

The first joining module 310 is configured to bobble the first bobbling component 306 in a predefined direction of motion. In one embodiment, the first joining module 310 could be configured to bobble the first bobbling component 306 in any desired direction of motion. The direction of motion includes an axis of motion. The first joining module 1204 is configured to bobble the first bobbling component 1202 in a predefined direction of motion. In one embodiment, the first joining module 1204 could be configured to bobble the first bobbling component 1202 in any desired direction of motion. The direction of motion includes an axis of motion.

Further, the second joining module 312 is configured to bobble the second bobbling component 308 in a predefined direction of motion. In one embodiment, the second joining module 312 could be configured to bobble the second bobbling component 308 in any desired direction of motion. The direction of motion includes an axis of motion. Further, the second joining module 708 is configured to bobble the second bobbling component 704 in a predefined direction of motion. In one embodiment, the second joining module 708 could be configured to bobble the second bobbling component 704 in any desired direction of motion. The direction of motion includes an axis of motion.

Still referring to FIG. 12, the first bobbling component 306 comprises a first end 306A and a second end 306B. Further, the first bobbling component 1202 comprises a first end 1202A and a second end 1202B. The first end 306A of the first bobbling component 306 is connected to a first end 302A of the first object 302 via the first joining module 310. The first end 1202A of the first bobbling component 1202 is connected to a first end 302B of the first object 302 via the first joining module 1204. The second end 306B of the first bobbling component 306 is connected to the second end 308B of the second bobbling component 308. The second end 1202B of the first bobbling component 1202 is connected to the second end 704B of the second bobbling component 704.

The first joining module 310, the second joining module 312, and the connected bobbling components (306, 308) enable the connected bobbling components (306, 308) to synergistically bobble in unison. The first joining module 1204, the second joining module 708, and the connected bobbling components (1202, 704) enable the connected bobbling components (1202, 704) to synergistically bobble in unison.

Figure 13:
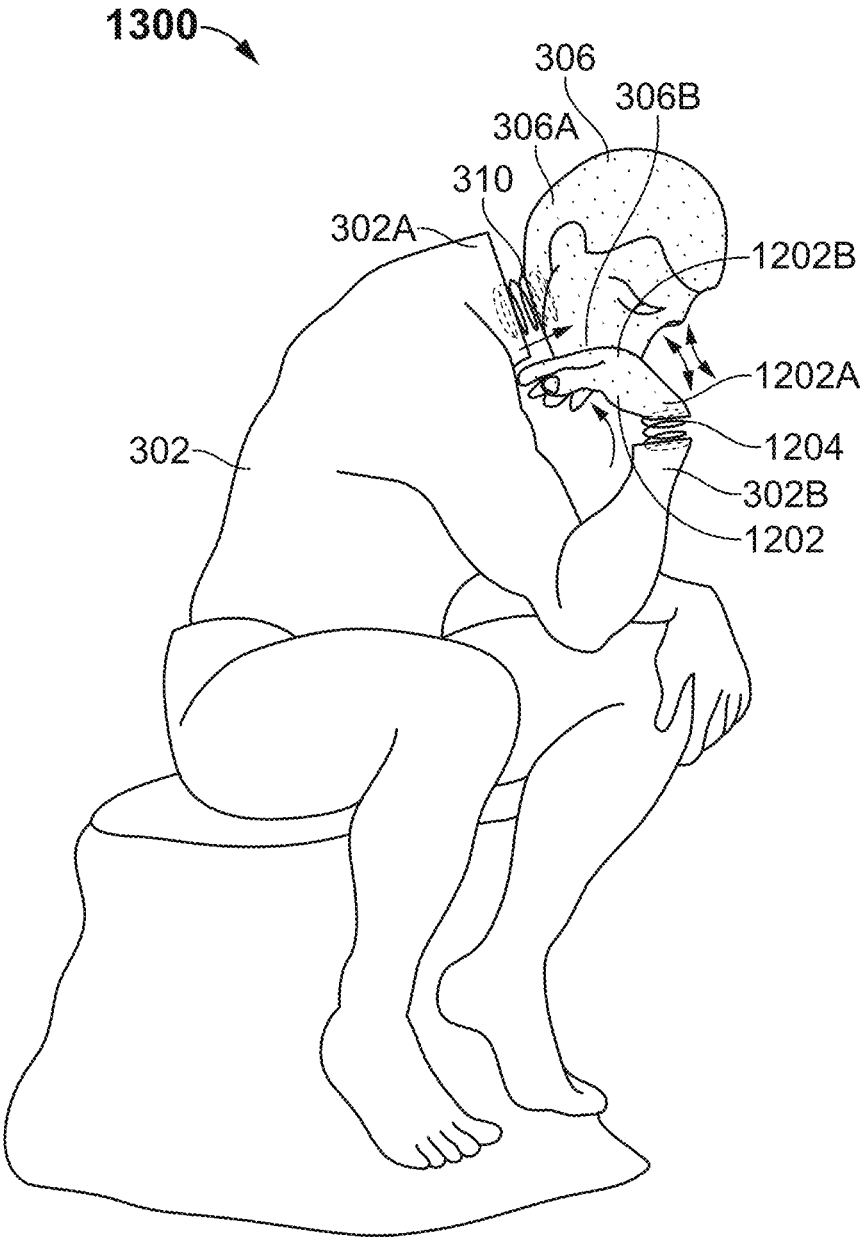
FIG. 13 exemplarily illustrates an articulating apparatus comprising a human figure having two connected bobbling components, according to yet another embodiment of the present invention.

Referring to FIG. 13, the apparatus 1300 comprises an object 302. The object 302 comprises two or more bobbling components (306, 1202). The object 302 comprises at least one first bobbling component 306 and at least one first bobbling component 1202. In one embodiment, the object 302 is a human figure and each bobbling component (306, 1202) is a limb or head of respective human figure. The apparatus 1300 further comprises two or more joining modules (310, 1204). The joining modules comprises at least one first joining module 310 and at least one first joining module 1204.

The first joining module 310 is configured to connect the first bobbling component 306 to the first object 302. The first joining module 1204 is configured to connect the first bobbling component 1202 to the first object 302. The first bobbling component 306 of the first object 302 is connected to the first bobbling component 1202 of the first object 302. In one embodiment, the first bobbling component 306 of the first object 302 is integrally connected to the first bobbling component 1202 of the first object 302. In one embodiment, the first bobbling component 306 of the first object 302 is detachably connected to the first bobbling component 1202 of the first object 302. The first joining module 310 is configured to move the first bobbling component 306 in a predefined direction of motion. In one embodiment, the first joining module 310 could be configured to bobble the first bobbling component 306 in any desired direction of motion. The direction of motion includes an axis of motion.

The first joining module 1204 is configured to bobble the first bobbling component 1202 in a predefined direction of motion. In one embodiment, the first joining module 1204 could be configured to bobble the first bobbling component 1202 in any desired direction of motion. The direction of motion includes an axis of motion. The first joining module 310, the first joining module 1204 and the connected bobbling components (306, 1202) enable the connected bobbling components (306, 1202) to synergistically bobble in unison.

Figure 14:
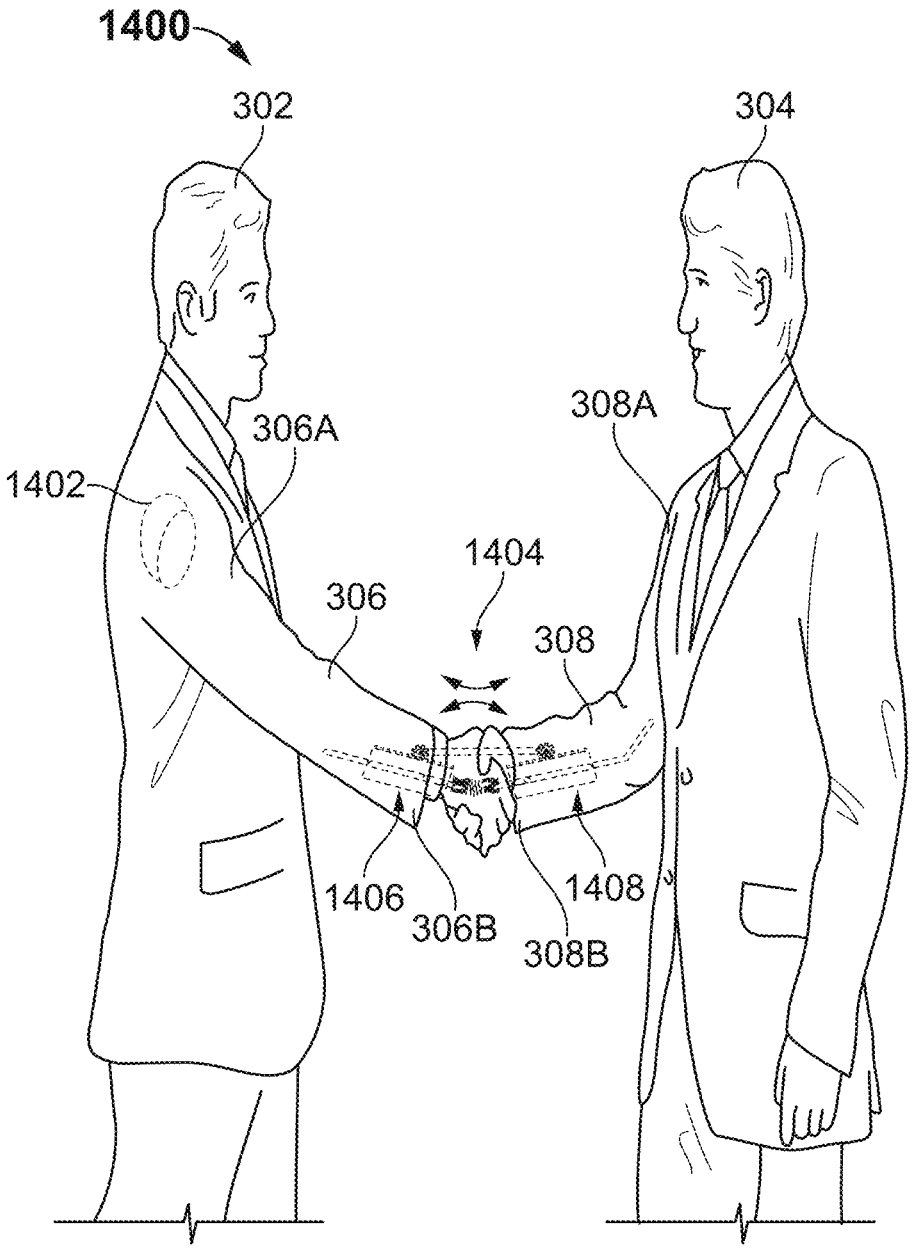
FIG. 14 exemplarily illustrates an articulating apparatus comprising two human figures and a connecting module to enable a handshake between two human figures, according to yet another embodiment of the present invention.

Referring to FIG. 14, the apparatus 1400 comprises one or more objects (302, 304). Each object (302, 304) comprises one or more bobbling components (306, 308). The one or more objects (302, 304) comprises a first object 302 and a second object 304. The first object 302 comprises at least one first bobbling component 306 and the second object 304 comprises at least one second bobbling component 308.

The apparatus 1400 further comprises one or more joining modules. The joining module comprises at least one ball and socket joint 1402. The first bobbling component 306 is attached to the first object 302 via at least one ball and socket joint 1402 and the second bobbling component 308 is attached to the second object 304 via at least one ball and socket joint 1402.

The apparatus 1400 further comprises one or more connecting modules 1404. The first bobbling component 306 is connected to the second bobbling component 308 via at least one connecting module 1404. At least one connecting member 1428 connects the connecting module 1404 to the first bobbling component 306 and at least another connecting member 1430 connects the connecting module 1404 to the second bobbling component The first bobbling component 306 comprises a first end 306A and a second end 306B. Further, the second bobbling component 308 comprises a first end 308A and a second end 308B. The first end 306A of the first bobbling component 306 is connected to a first end 302A of the first object 302. The first end 308A of the second bobbling component 308 is connected to a first end 304A of the second object 304. The second end 306B of the first bobbling component 306 is connected to the second end 308B of the second bobbling component 308 via the connecting module 1404.

Figure 15:
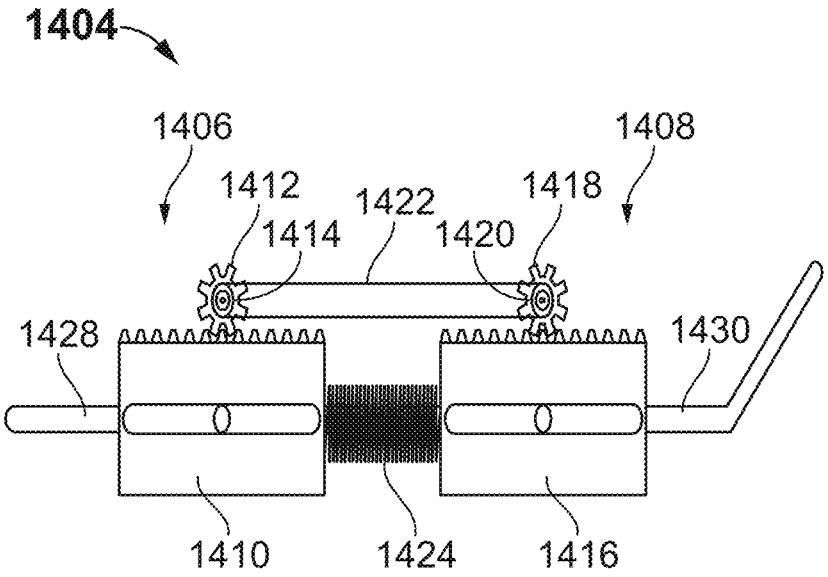
FIG. 15 exemplarily illustrates an operating state of the connecting module of FIG. 14.
Figure 16:
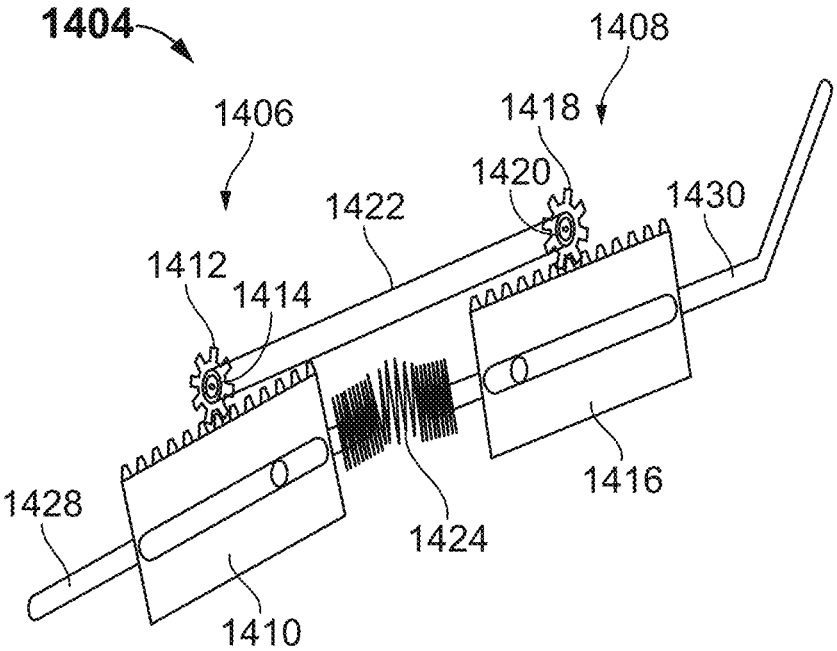
FIG. 16 exemplarily illustrates another operating state of the connecting module of FIG. 14

Referring to FIG. 14 to FIG. 16, the connecting module 1404 comprises a first pinion and rack set 1406 connected to the second end 306B of the first bobbling component 306, and a second pinion and rack set 1408 connected to the second end 1408 of the second bobbling component 308. The first pinion and rack set 1406 comprises a first rack 1410 and a first pinion 1412 disposed over a first shaft 1414. The first pinion 1412 drivingly engaged to the first rack 1410 to cause linear translation of the first rack 1410 coincident with the rotation of the first pinion 1412.

The second rack and pinion set 1408 comprising a second rack 1416 and a second pinion 1418 disposed over a second shaft 1420. The second pinion 1418 drivingly engaged to the second rack 1416 to cause linear translation of the second rack 1416 coincident with the rotation of the second pinion 1418.

The connecting module 1404 further comprises a conveyer belt 1422 is configured to mechanically couple the first shaft 1414 and the second shaft 1420 and transmit rotational motion between the first pinion 1412 and the second pinion 1418. The connecting module 1404 further comprises a spring 1424 disposed between the first and second rack (1410, 1416). When the first rack 1410 moves against the second rack 1416 on application of rotational force on one of the first pinion 1412 and the second pinion 1418, the spring 1424 is configured to retract. Further, when the first rack 1410 moves away from the second rack 1416 on application of rotational force on one of the first pinion 1412 and the second pinion 1418, the spring 1424 is configured to expand. Thereby, the connecting module 1404 imparts bobbling movement between the first bobbling component 306 and the second bobbling component 308 and the bobbling components (306, 308) to synergistically move in unison. In one embodiment, the rotational force could be applied to the connecting module 1404 by an electromechanical device including, but not limited to, electric motor, solenoid and electromagnet. In another embodiment, the rotational force could be applied to the connecting module 1404 by manual manipulation.

Figure 17:
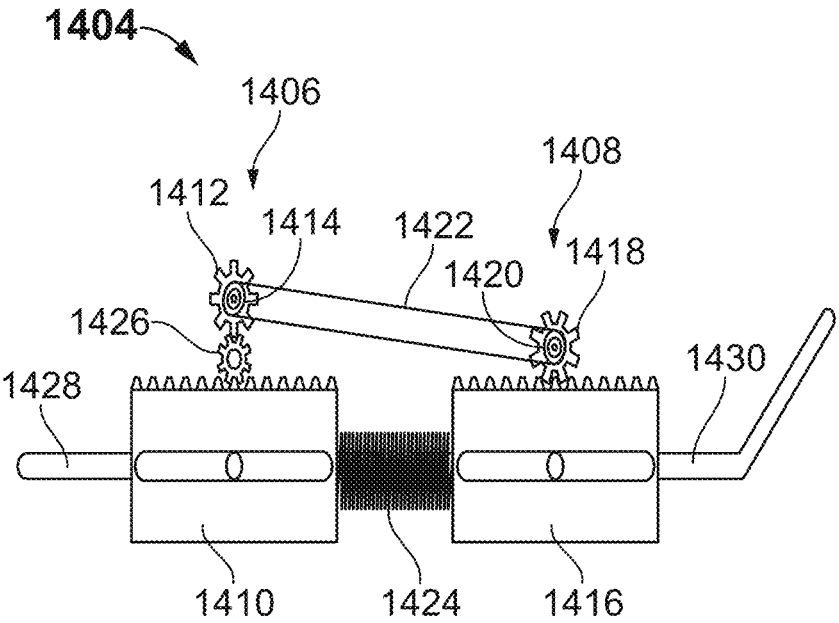
FIG. 17 exemplarily illustrates the connecting module of FIG. 14 having an intermediate pinion.
Figure 18:
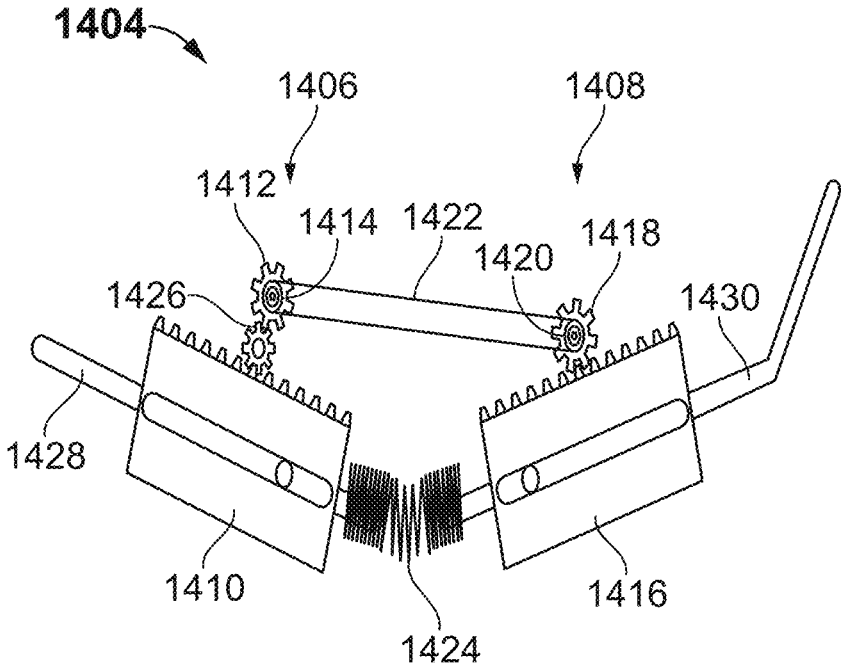
FIG. 18 exemplarily illustrates an operating state of the connecting module of FIG. 14 having the intermediate pinion.

Referring to FIG. 17 and FIG. 18, in another embodiment, the connecting module 1402 further comprises an intermediate pinion 1426. The intermediate pinion 1426 is configured to receive external rotational force. The intermediate pinion 1426 drivingly engaged to the first rack 1410 to cause linear translation of the first rack 1410 coincident with the rotation of the intermediate pinion 1426. Further, the first pinion 1412 is mechanically engaged to the intermediate pinion 1426. Further, the first pinion 1412 is mechanically engaged to the second pinion 1418. The conveyer belt 1422 is configured to mechanically couple the first shaft 1414 and the second shaft 1420 and transmit rotational motion between the first pinion 1412 and the second pinion 1418.

When the first rack 1410 moves against the second rack 1416 on application of rotational force on one of the intermediate pinion 1426 and the second pinion 1418, the spring 1424 is configured to retract. Further, when the first rack 1410 moves away from the second rack 1416 on application of rotational force on one of the intermediate pinion 1426 and the second pinion 1418, the spring 1424 is configured to expand. Thereby, the connecting module 1404 imparts bobbling movement between the first bobbling component 306 and the second bobbling component 308 and the bobbling components (306, 308) to synergistically move in unison.

Figure 19:
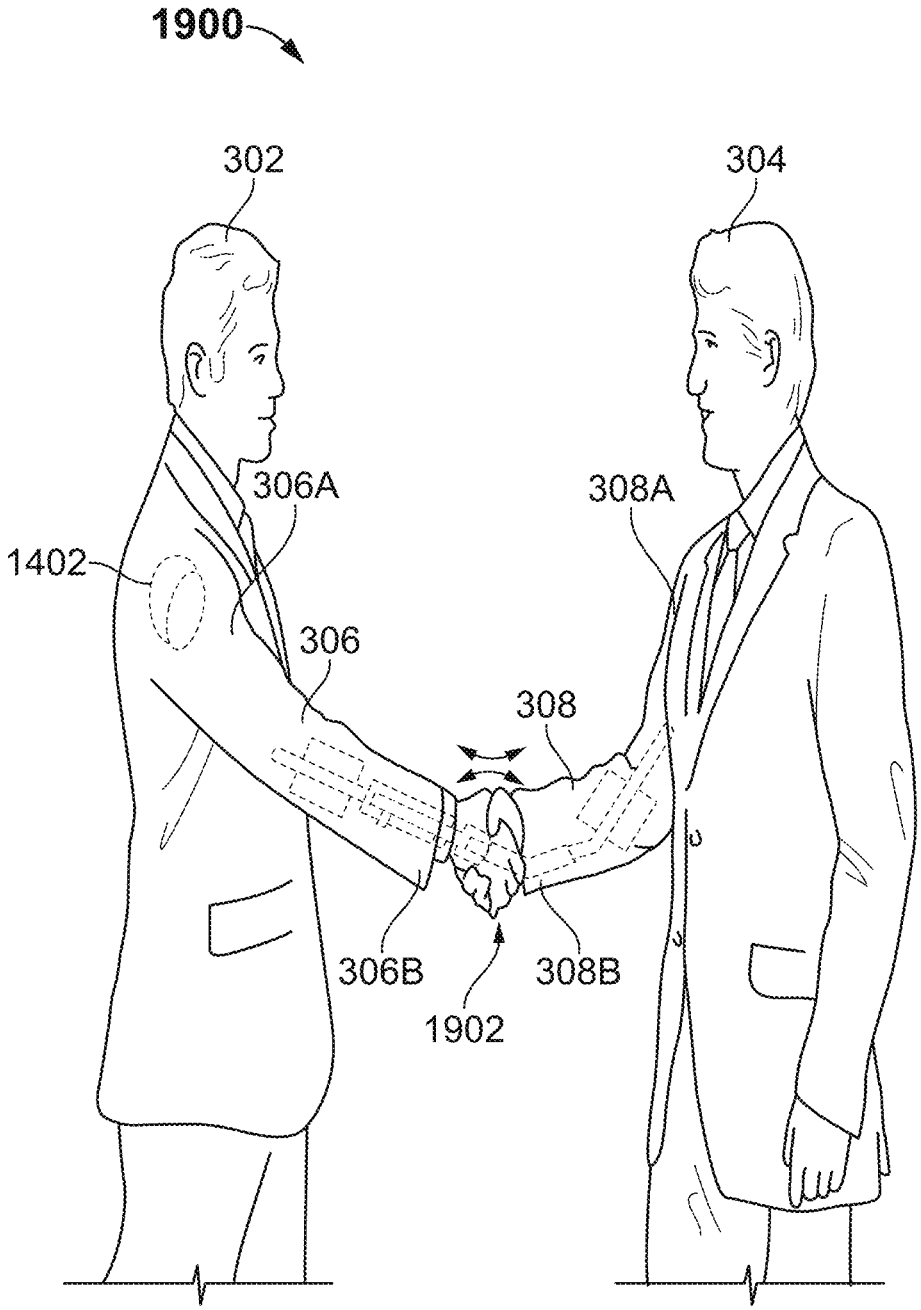
FIG. 19 exemplarily illustrates an articulating apparatus comprising two human figures and a connecting module to enable a handshake between two human figures, according to yet another embodiment of the present invention.

Referring to FIG. 19, the apparatus 1900 comprises one or more objects (302, 304). Each object (302, 304) comprises one or more bobbling components (306, 308). The one or more objects (302, 304) comprises a first object 302 and a second object 304. The first object 302 comprises at least one first bobbling component 306 and the second object 304 comprises at least one second bobbling component 308.

The apparatus 1900 further comprises one or more joining modules. The joining module comprises at least one ball and socket joint 1402. The first bobbling component 306 is attached to the first object 302 via at least one ball and socket joint 1402 and the second bobbling component 308 is attached to the second object 304 via at least one ball and socket joint 1402.

The apparatus 1900 further comprises one or more connecting modules 1902. The first bobbling component 306 is connected to the second bobbling component 308 via at least one connecting module 1902. At least one connecting member 1904 connects the connecting module 1902 to the first bobbling component 306 and at least another connecting member 1906 connects the connecting module 1902 to the second bobbling component 308.

The first bobbling component 306 comprises a first end 306A and a second end 306B. Further, the second bobbling component 308 comprises a first end 308A and a second end 308B. The first end 306A of the first bobbling component 306 is connected to a first end 302A of the first object 302. The first end 308A of the second bobbling component 308 is connected to a first end 304A of the second object 304. The second end 306B of the first bobbling component 306 is connected to the second end 308B of the second bobbling component 308 308 via the connecting module 1902.

Figure 20:
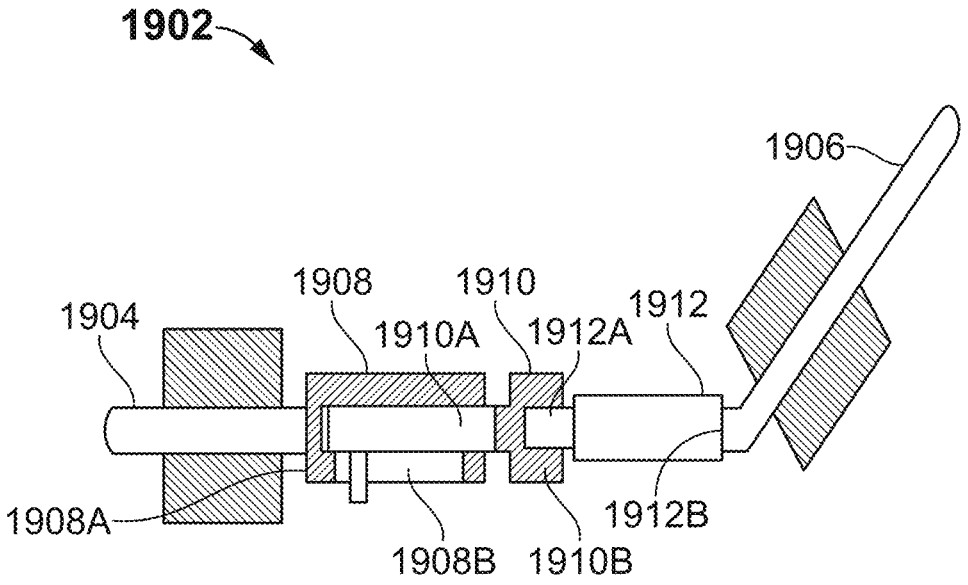
FIG. 20 exemplarily illustrates an operating state of the connecting module of FIG. 19.
Figure 21:
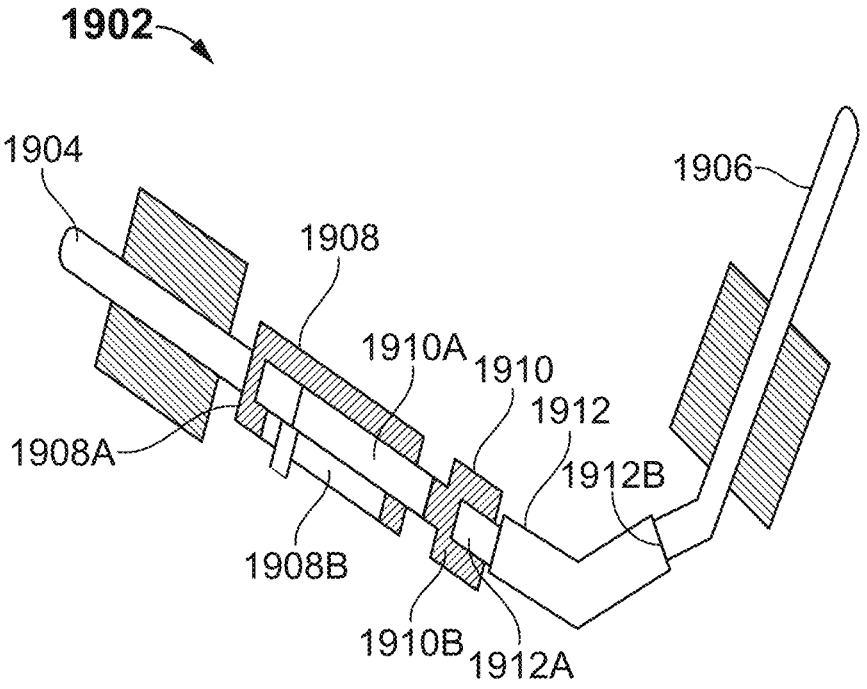
FIG. 21 exemplarily illustrates another operating state of the connecting module of FIG. 19.

Referring to FIG. 20 and FIG. 21, the connecting module 1902 comprises a receptacle member 1908 having a first portion 1908A and a second portion 1908B opposite to the first portion 1908A. The first portion 1908A of the receptacle member 1908 is connected to at least one bobbling component 306.

The connecting module 1902 further comprises a mobile member 1910 having a first portion 1910A and a second portion 1910B opposite to the first portion 1910A. The mobile member 1910 is configured to linearly move within the second portion 1908B of the receptacle member 1908.

The connecting module 1902 further comprises an elastic member 1912 having a first portion 1912A and a second portion 1912B opposite to the first portion 1912A. The first portion 1912A of the elastic member 1912 is connected to the second portion 1910B of the mobile member 1910 and the second portion 1912B of the mobile member 1910 is connected to the at least one other bobbling component 308.

When the mobile member 1910 moves towards the first portion 1908A of the receptacle member 1908, the elastic member 1912 is enabled to expand, and when the mobile member 1910 moves away from the first portion 1908A of the receptacle member 1908, the elastic member 1912 is enabled to contract, thereby the connecting module 1902 imparts movement to at least two bobbling components (306, 308).

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It is further clarified that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable other individuals of ordinary skill in the art to understand the disclosure for various embodiments with various modifications as are suited to the particular use contemplated.

What is claimed is:

1. An articulated apparatus, comprising:

one or more objects, wherein each object comprises one or more bobbling components, wherein two or more bobbling components of the one or more objects are connected together, one or more joining modules configured to movably connect each bobbling component to the respective object and enables the two or more connected bobbling components of the one or more objects to bobble synergistically in unison, and one or more connecting modules configured to connect the two or more bobbling components of the one or more objects, wherein the one or more connecting modules comprises:

a first rack and pinion set connected to at least one bobbling component, the first rack and pinion set comprising a first rack and a first pinion disposed over a first shaft, the first pinion drivingly engaged to the first rack to cause linear translation of the first rack coincident with a rotation of the first pinion, a second rack and pinion set connected to at least another bobbling component, the second rack and pinion set comprising a second rack and a second pinion disposed over a second shaft, the second pinion drivingly engaged to the second rack to cause linear translation of the second rack coincident with a rotation of the second pinion, a conveyer belt configured to mechanically couple the first shaft and the second shaft and transmit rotational motion between the first pinion and the second pinion, and a spring disposed between the first and second rack, when the first rack moves toward the second rack on application of rotational force on one of the first pinion and the second pinion, the spring is configured to retract, and when the first rack moves away from the second rack on application of rotational force on one of the first pinion and the second pinion, the spring is configured to expand, thereby the one or more connecting modules imparts bobbling movement to at least two bobbling components.

2. The apparatus of claim 1, wherein the one or more joining modules comprises one or more components selected from a group comprising one or more magnets, one or more electromagnets, a spring, a conical spring, a leaf spring, a compression spring, a torsional spring, a garter spring, a hinge joint, a pivot joint, a prismatic joint, a ball-socket joint and an electromechanical device.

3. The apparatus of claim 1, wherein the one or more objects comprising a first object, the first object comprising at least two first bobbling components, the one or more joining modules comprising at least two first joining modules such that each first bobbling component is connected to the first object via a respective one of the first joining modules, at least two first bobbling components are attached to one another via one of the connecting modules, to enable the connected first bobbling components to bobble synergistically in unison.

4. The apparatus of claim 1, wherein the one or more objects comprises a first object and a second object, the one or more joining modules including at least one first joining module and at least one second joining modules, the first object comprising at least one first bobbling component and the second object comprising at least one second bobbling component, wherein each first bobbling component is movably connected to the first object via one of the first joining modules and each second bobbling component is movably connected to the second object via one of the second joining modules, wherein at least one of the first bobbling components is connected to at least one of the second bobbling components via one of the connecting modules, and wherein at least one of the first bobbling components is connected to at least one of the second bobbling components via one of the connecting modules to enable the connected first and second bobbling components to bobble synergistically in unison.

* * * * *